US008845045B2

(12) United States Patent
Stubblefield

(10) Patent No.: US 8,845,045 B2
(45) Date of Patent: Sep. 30, 2014

(54) DOOR CLOSING CONTROL AND ELECTRICAL CONNECTIVITY SYSTEM FOR REFRIGERATED CASE

(75) Inventor: Steven O. Stubblefield, Mechanicsville, VA (US)

(73) Assignee: Hill Phoenix, Inc., Conyers, GA (US)

( * ) Notice: Subject to any disclaimer, the term of this patent is extended or adjusted under 35 U.S.C. 154(b) by 69 days.

(21) Appl. No.: 13/103,680

(22) Filed: May 9, 2011

(65) Prior Publication Data

US 2011/0304254 A1 Dec. 15, 2011

Related U.S. Application Data

(60) Provisional application No. 61/353,061, filed on Jun. 9, 2010.

(51) Int. Cl.

| | |
|---|---|
| ***A47B 96/04*** | (2006.01) |
| ***A47F 3/04*** | (2006.01) |
| ***F25D 11/00*** | (2006.01) |
| ***E05F 1/08*** | (2006.01) |
| ***E05F 1/10*** | (2006.01) |
| ***E05D 7/08*** | (2006.01) |
| ***E05D 7/081*** | (2006.01) |
| ***E05D 7/10*** | (2006.01) |
| ***F25D 23/02*** | (2006.01) |
| ***E05D 11/00*** | (2006.01) |

(52) U.S. Cl.

CPC ..... *A47F 3/0426* (2013.01); *E05F 1/1025* (2013.01); *E05D 7/08* (2013.01); *E05D 7/081* (2013.01); *E05D 7/1011* (2013.01); *F25D 23/028* (2013.01); *F25D 2323/024* (2013.01); *E05Y 2900/202* (2013.01); *E05D 11/0081* (2013.01)

USPC ..... 312/405; 312/116; 16/299; 16/308

(58) Field of Classification Search

CPC ..... E05D 11/0081; E05D 7/08; E05F 1/123; F25D 23/028

USPC ..... 312/116, 326, 327, 328, 329, 405, 312/223.6, 319.5, 319.6, 319.7, 319.8; 62/448, 449, 465; 362/94, 125; 49/400, 49/401, 402, 138, 236, 237, 239; 16/298, 16/299, 301, 307, 308

See application file for complete search history.

(56) References Cited

U.S. PATENT DOCUMENTS 1,347,161 A 7/1920 Hornung
2,651,074 A * 9/1953 Slopa et al. ..... 16/80

(Continued)

FOREIGN PATENT DOCUMENTS

EP 0088670 * 1/1987
WO WO 2009/100940 A2 8/2009

OTHER PUBLICATIONS

U.S. Appl. No. 13/086,320, filed Apr. 13, 2011, Stubblefield.

(Continued)

*Primary Examiner* — Daniel Rohrhoff
*Assistant Examiner* — Kimberley S Wright
(74) *Attorney, Agent, or Firm* — Foley & Lardner LLP

(57) ABSTRACT

A temperature-controlled case is provided including a frame and a door coupled to the frame and pivotable about a pivot axis between a closed position and an open position. The door includes a passage that interchangeably receives a door closure control assembly at one of the top or the bottom of the door, and an electrical connectivity system at the other of the top or the bottom of the door. The electrical connectivity system includes a first electrical connector coupled to the door, and a second electrical connector coupled to the frame so that the first and second electrical connectors are engaged when the door is coupled to the frame. The door closure control assembly includes a torsion spring that is fixed at one end to the door and fixed at another end to the frame, so that when the door is opened the torsion spring provides an increasing force to urge the door toward the closed position.

22 Claims, 23 Drawing Sheets

(56) References Cited

U.S. PATENT DOCUMENTS

| | | | | | |
|---|---|---|---|---|---|
| 3,061,871 | A | * | 11/1962 | Swanson | 16/308 |
| 3,076,163 | A | * | 1/1963 | Nodge et al. | 439/31 |
| 3,089,202 | A | * | 5/1963 | Pulaski | 49/70 |
| 3,091,819 | A | * | 6/1963 | Wheeler et al. | 49/386 |
| 3,156,019 | A | * | 11/1964 | Dawley | 49/70 |
| 3,177,989 | A | | 4/1965 | Di Chiaro | |
| 3,254,452 | A | * | 6/1966 | Costantini et al. | 49/386 |
| 3,339,225 | A | * | 9/1967 | Summer | 16/300 |
| 3,403,525 | A | | 10/1968 | Beckwith, et al. | |
| 3,518,716 | A | * | 7/1970 | Larson | 16/284 |
| 3,629,972 | A | * | 12/1971 | Rehberg et al. | 49/240 |
| 3,673,735 | A | | 7/1972 | Winsler et al. | |
| 3,729,603 | A | * | 4/1973 | Foltz | 200/61.7 |
| 3,771,323 | A | | 11/1973 | Simons et al. | |
| 4,034,572 | A | | 7/1977 | Morris et al. | |
| 4,067,628 | A | | 1/1978 | Sherburn | |
| 4,127,765 | A | * | 11/1978 | Heaney | 219/218 |
| 4,145,844 | A | | 3/1979 | Kaspar | |
| 4,215,449 | A | * | 8/1980 | Loikitz | 16/50 |
| 4,543,800 | A | * | 10/1985 | Mawby et al. | 62/339 |
| 4,548,049 | A | * | 10/1985 | Rajgopal | 62/275 |
| 4,578,902 | A | * | 4/1986 | Niekrasz et al. | 49/70 |
| 4,592,209 | A | | 6/1986 | Casanova et al. | |
| 4,671,582 | A | * | 6/1987 | Stromquist et al. | 439/31 |
| 4,696,078 | A | * | 9/1987 | Stromquist | 16/301 |
| 4,753,043 | A | | 6/1988 | Bockwinkel | |
| 4,905,347 | A | * | 3/1990 | Wroth | 16/308 |
| 4,953,363 | A | | 9/1990 | Primozic | |
| 5,054,163 | A | * | 10/1991 | Sterling et al. | 16/244 |
| 5,113,628 | A | | 5/1992 | Richardson et al. | |
| 5,174,640 | A | | 12/1992 | Kuwahara et al. | |
| 5,228,240 | A | * | 7/1993 | Barroero et al. | 49/386 |
| 5,301,092 | A | | 4/1994 | Santosuosso et al. | |
| 5,321,870 | A | * | 6/1994 | Wada et al. | 16/300 |
| 5,333,355 | A | * | 8/1994 | Beswick et al. | 16/300 |
| 5,363,611 | A | * | 11/1994 | Richardson et al. | 312/116 |
| 5,454,471 | A | | 10/1995 | Norvell | |
| RE35,149 | E | * | 1/1996 | Richardson et al. | 52/204.593 |
| RE35,392 | E | * | 12/1996 | Richardson et al. | 52/172 |
| 5,636,484 | A | | 6/1997 | DeBlock | |
| 5,645,330 | A | | 7/1997 | Artwohl et al. | |
| 5,787,724 | A | * | 8/1998 | Pohl et al. | 62/389 |
| 5,895,111 | A | | 4/1999 | Santosuosso et al. | |
| 5,941,619 | A | * | 8/1999 | Stieben et al. | 312/223.6 |
| 5,946,933 | A | | 9/1999 | Clarke et al. | |
| 6,029,411 | A | | 2/2000 | Richardson | |
| 6,138,341 | A | * | 10/2000 | Barroero et al. | 29/527.1 |
| 6,144,017 | A | * | 11/2000 | Millett et al. | 219/522 |
| 6,148,563 | A | | 11/2000 | Roche et al. | |
| 6,209,265 | B1 | * | 4/2001 | Banicevic et al. | 49/501 |
| 6,345,693 | B1 | | 2/2002 | Yeo et al. | |
| 6,393,768 | B1 | | 5/2002 | Roche et al. | |
| 6,401,399 | B1 | * | 6/2002 | Roche et al. | 49/501 |
| 6,406,108 | B1 | * | 6/2002 | Upton et al. | 312/116 |
| 6,578,979 | B2 | | 6/2003 | Truttmann-Battig | |
| 6,606,833 | B2 | | 8/2003 | Richardson et al. | |
| 6,820,952 | B2 | | 11/2004 | Austin et al. | |
| 6,978,516 | B1 | * | 12/2005 | Calderon et al. | 16/235 |
| 7,213,375 | B2 | | 5/2007 | Morgan et al. | |
| 7,243,394 | B2 | * | 7/2007 | Kao | 16/50 |
| 7,244,058 | B2 | | 7/2007 | DiPenti et al. | |
| 7,246,470 | B2 | | 7/2007 | Beyrle | |
| 7,318,321 | B2 | | 1/2008 | Grassmuck et al. | |
| 7,434,950 | B2 | | 10/2008 | Whitney | |
| 7,513,637 | B2 | | 4/2009 | Kelly et al. | |
| 7,681,369 | B2 | | 3/2010 | Soltesiz et al. | |
| 7,681,409 | B2 | | 3/2010 | Alahyari et al. | |
| 7,766,497 | B2 | | 8/2010 | Sommers et al. | |
| 7,856,770 | B2 | | 12/2010 | Grassmuck et al. | |
| 7,870,704 | B2 | | 1/2011 | Riblier et al. | |
| 7,871,176 | B2 | | 1/2011 | Kelly et al. | |
| 7,891,154 | B2 | | 2/2011 | Cording | |
| 7,954,979 | B2 | | 6/2011 | Sommers et al. | |
| 8,038,312 | B2 | | 10/2011 | Otsuki et al. | |
| 8,057,061 | B2 | | 11/2011 | Otsuki et al. | |
| 8,117,865 | B2 | * | 2/2012 | Allard et al. | 62/440 |
| 2002/0051357 | A1 | | 5/2002 | Truttmann-Battig | |
| 2002/0062654 | A1 | | 5/2002 | Navarro | |
| 2004/0194388 | A1 | * | 10/2004 | Roche et al. | 49/120 |
| 2005/0217306 | A1 | | 10/2005 | Renaud | |
| 2006/0021368 | A1 | | 2/2006 | Jaffer et al. | |
| 2006/0059861 | A1 | | 3/2006 | Grassmuck et al. | |
| 2006/0103269 | A1 | | 5/2006 | Artwohl et al. | |
| 2006/0162361 | A1 | | 7/2006 | Roche et al. | |
| 2007/0022667 | A1 | | 2/2007 | Olofsson | |
| 2007/0159820 | A1 | | 7/2007 | Crandell et al. | |
| 2008/0007945 | A1 | | 1/2008 | Kelly et al. | |
| 2008/0122324 | A1 | * | 5/2008 | Bienick | 312/116 |
| 2008/0158858 | A1 | * | 7/2008 | Madireddi et al. | 362/92 |
| 2008/0186695 | A1 | | 8/2008 | Awai et al. | |
| 2008/0186696 | A1 | | 8/2008 | Awai et al. | |
| 2008/0211359 | A1 | | 9/2008 | Borgstrom et al. | |
| 2009/0072679 | A1 | | 3/2009 | Avila et al. | |
| 2009/0108724 | A1 | * | 4/2009 | Jang | 312/406 |
| 2009/0151265 | A1 | | 6/2009 | Gillen | |
| 2009/0249811 | A1 | | 10/2009 | Shin | |
| 2009/0288343 | A1 | | 11/2009 | Romolo | |
| 2010/0062152 | A1 | | 3/2010 | Roche et al. | |
| 2010/0068398 | A1 | | 3/2010 | Roche et al. | |
| 2010/0119705 | A1 | | 5/2010 | Roche et al. | |
| 2010/0139036 | A1 | | 6/2010 | Romolo | |
| 2010/0192468 | A1 | | 8/2010 | Chubb et al. | |
| 2010/0205991 | A1 | | 8/2010 | Ernst et al. | |
| 2010/0214769 | A1 | | 8/2010 | Bhargava et al. | |
| 2011/0043089 | A1 | | 2/2011 | Chubb et al. | |
| 2011/0058357 | A1 | | 3/2011 | Anderson | |
| 2011/0100044 | A1 | | 5/2011 | Reichert et al. | |
| 2011/0126561 | A1 | | 6/2011 | Sunderland et al. | |
| 2011/0302944 | A1 | | 12/2011 | Howington et al. | |

OTHER PUBLICATIONS

U.S. Appl. No. 13/101,047, filed May 4, 2011, Howington et al.
U.S. Appl. No. 13/105,703, filed May 11, 2011, Howington et al.

* cited by examiner 538
538a
552
514
550
554
596
590
554
550
552
540

DOOR CLOSING CONTROL AND ELECTRICAL CONNECTIVITY SYSTEM FOR REFRIGERATED CASE

CROSS REFERENCE TO RELATED APPLICATIONS

The present Application claims the benefit of priority under 35 U.S.C. §119(e)(1) of U.S. Provisional Patent Application No. 61/353,061, titled "Door Closing Control and Electrical Connectivity System for a Refrigerated Case" and filed on Jun. 9, 2010, the disclosure of which is incorporated herein by reference in its entirety.

BACKGROUND

The present invention relates generally to the field of temperature-controlled cases. More specifically, the present invention relates to door closing controls, electrical connectivity systems, and other coupling devices for temperature-controlled cases.

It is well known to provide coupling mechanisms or devices for pivotally coupling a door to a temperature-controlled case, such as a refrigerator, freezer, refrigerated merchandiser, refrigerated display case, etc. that may be used in commercial, institutional, and residential applications. However, conventional doors for temperature-controlled cases are often difficult and time-consuming to install, replace, and repair. Also, conventional doors have a tendency to remain open or delay closing, allowing cooled or heated air to leave a temperature-controlled space and potentially creating significant energy inefficiencies.

Further, conventional frames for such cases often include various electrical devices (e.g., a ballast and a power supply associated with one or more lighting devices within the temperature-controlled space, etc.) housed therein or integrally formed therewith. These electrical devices are difficult to access (e.g., for repair or maintenance) and also act as a source of heat, which is particularly undesirable for applications wherein the temperature-controlled case is a chilled or cooled case.

An improved temperature-controlled case is provided.

SUMMARY

One embodiment of the invention relates to a temperature-controlled case that comprises a frame at least partially defining a temperature-controlled space; a modular door, the modular door movable about a pivot axis between a closed position and an open position for providing access to the temperature-controlled space; and a door closing control configured to bias the modular door toward the closed position. The door closing control comprises a hinge coupled to the frame, the hinge including a rotatable portion with a first cam surface and a non-rotatable portion having a second cam surface, the rotatable portion and the non-rotatable portion axially aligned with one another along the pivot axis, and a spring biasing the non-rotatable portion toward the rotatable portion so that the first and second cam surfaces engage one another. The door closing control further comprises a torque transfer coupling including a first element removably coupled to a second element, the first element coupled to the door and the second element coupled to the hinge, and a first electrical connector at least partially disposed within the first element and a second electrical connector at least partially disposed within the second element. Coupling the first element and the second element of the torque transfer coupling electrically couples the first electrical connector and the second electrical connector to one another. The temperature-controlled case further comprises at least one compartment separate from and adjacent to the modular door and one or more electrical devices disposed in the compartment, an electrical connection between the electrical devices in the compartment and the modular door being formed when the first element and second element of the torque transfer coupling are coupled to one another.

Another embodiment of the invention relates to a temperature-controlled case, having a frame at least partially defining a temperature-controlled space, and a door pivotable about a pivot axis between a closed position and an open position, the door including a raceway passage. A door closure device has an elongated bar that biases the door toward the closed position. The door closure device is coupled to one of a top or a bottom of the door and to the frame. An electrical connectivity system includes a first electrical connector coupled to the other of the top or the bottom of the door and engages a second electrical connector coupled to the frame. There is at least one compartment within the frame and one or more electrical devices are disposed in the compartment. An electrical connection between the electrical devices in the compartment and the door being is formed when the first electrical connector is coupled to the second electrical connector.

Another embodiment of the invention relates to a temperature-controlled case that includes a frame and a door coupleable to the frame and pivotable about a pivot axis between a closed position and an open position. At least one compartment is separate from and adjacent to the modular door, where the compartment houses one or more electrical devices. An electrical connectivity system includes a first coupling device removably engagable with a second coupling device. A first electrical connector is disposed within the first coupling device and a second electrical connector is disposed within the second coupling device. When the first coupling device is coupled to the second coupling device the first electrical connector and the second electrical connector are also coupled to on another. Coupling the first electrical connector and the second electrical connector together forms an electrical connection between the one or more electrical devices disposed in the compartment and the door.

Another embodiment of the invention relates to a temperature-controlled case that includes a frame and a door pivotable about a pivot axis between a closed position and an open position. A door closing control assembly biases the door toward the closed position and includes an elongated bar having a first end removably received within a passage in the door and rotationally fixed to the door, and a second end that is removably received within an aperture in the frame and rotationally fixed to the frame, so that the elongated bar increasingly twists as the door is moved from the closed position toward the open position.

Another embodiment of the invention relates to a temperature-controlled case having a door pivotable between an open position and a closed position. The case includes a hinge for transforming pivotal motion into linear motion. The hinge includes a spring and a first coupling device including a first element removably coupleable to a second element. Pivoting one of the first element and second element of the first coupling device imparts pivotal motion to the other element. When the door is coupled to the frame and in the open position, the spring is compressed a first distance in a first direction and provides a translational force in a second direction opposite the first direction, the translational force operably imparting a rotational force on the door in the direction to move the door from the open position to the closed position.

Yet another embodiment of the invention relates to a temperature-controlled case and includes a frame and a door coupled to the frame and pivotable about a pivot axis between a closed position and an open position. The door includes a passage that interchangeably receives a door closure control assembly at one of the top or the bottom of the door, and an electrical connectivity system at the other of the top or the bottom of the door. The electrical connectivity system includes a first electrical connector coupled to the door, and a second electrical connector coupled to the frame so that the first and second electrical connectors are engaged when the door is coupled to the frame. The door closure control assembly includes a torsion spring that is fixed at one end to the door and fixed at another end to the frame, so that when the door is opened the spring provides an increasing force to urge the door toward the closed position.

DETAILED DESCRIPTION

Referring to the FIGURES, various embodiments of a door closing control and an electrical connectivity system for a temperature-controlled case are disclosed. The door closing control is configured to bias a door of the temperature-controlled case toward the closed position. In some exemplary embodiments, the door closing control is configured to bias the door of the temperature-controlled case toward the closed position both when the door is in the open position and when the door is in the closed position. The electrical connectivity system is configured to provide an electrical connection between the door of the temperature-controlled case and electrical devices external thereto.

The door closing control and the electrical connectivity system may provide for quick mechanical and electrical coupling (and uncoupling) of the modular door system to (and from) a frame of the temperature-controlled case and electrical devices included therein and/or utilized therewith. These devices/systems may operate in a plug-and-play manner. In some exemplary embodiments, the mechanical coupling and the electrical coupling are formed substantially simultaneously, as will be discussed in more detail below. In this way, the door closing control and the electrical connectivity system may provide for efficient installation and removal of a modular door system. Further, this configuration allows electrical devices that are more conventionally located within a door of a temperature-controlled case to be located external thereto, facilitating repair and maintenance of these electrical devices. These benefits, as well as others, will be discussed in more detail below.

Figure 1:
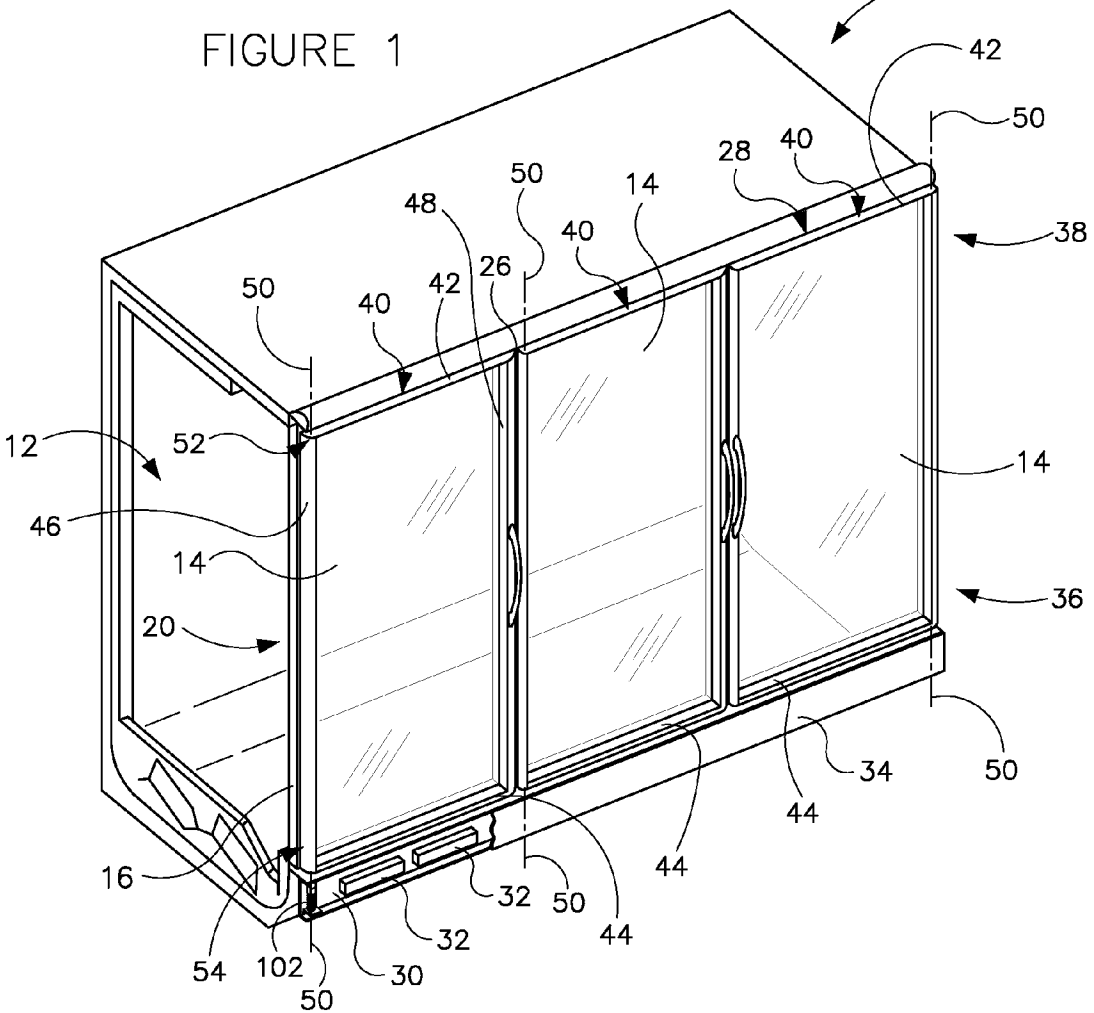
FIG. 1 is a front perspective view of a temperature-controlled case according to a first exemplary embodiment with a side wall removed.

Referring to FIG. 1, a temperature-controlled case, shown as a refrigerated case 10, is shown according to an exemplary embodiment. The refrigerated case 10 is configured to store or display goods in an interior space or cavity 12 that is temperature-controlled (here, chilled or cooled) to maintain the goods at a desired temperature. The refrigerated case 10 includes one or more doors, shown as modular door systems 14. The modular door systems 14 allow a customer or other user to access the goods stored or displayed in the interior space 12 of the refrigerated case. Further, the modular door systems 14 act as a barrier between the environment external to the refrigerated case 10 and the interior space 12, helping to maintain the interior space 12 of the refrigerated case 10 at a desired temperature. While the refrigerated case 10 is shown as a straight case, the refrigerated case may be any temperature-controlled case that utilizes one or more doors to allow for access to goods stored or displayed there. Further, while the doors are shown as modular door systems, the concepts disclosed herein may be utilized with and/or applied to any door for a temperature-controlled case.

Referring further to FIG. 1, the refrigerated case 10 includes a support structure shown as a refrigerated case frame 16 according to an exemplary embodiment. The refrigerated case frame 16 supports the modular door systems 14. At a front side 20 of the refrigerated case 10, the refrigerated case frame 16 includes at least one header 22 (see FIGS. 10 and 11), at least one sill 24 (see FIGS. 8 and 9), and a plurality of mullions 26 that define openings corresponding to the locations of the modular door systems 14. When coupled to the refrigerated case frame 16, an interior side of the modular door system 14 faces the interior space 12 of the refrigerated case 10 and an opposing exterior side 28 faces away from the interior space 12.

The refrigerated case 10 further includes at least one compartment 30 according to an exemplary embodiment. The compartment 30 (e.g., box, partition, storage space, etc.) is configured to house (e.g., store, accommodate, etc.) one or more electrical devices 32. The compartment 30 is shown separate from and adjacent to the modular door systems 14. Further, the compartment 30 is closed off by a movable or removable panel 34 that is configured to allow access to the electrical devices 32 stored in the compartment 30. While the compartment 30 is shown disposed substantially along a lower side 36 of the refrigerated case 10 generally below the modular door systems 14, the compartment 30 may be disposed substantially along an upper side 38 of the refrigerated case 10 generally above the modular door systems 14 or at any other suitable location.

The compartment 30 may house a number of electrical devices 32 that are typically housed in or integrated within the door of a temperature-controlled case (e.g., a ballast and a power supply associated with one or more lighting devices within the temperature-controlled space, etc.) according to an exemplary embodiment. This configuration provides a number of benefits. One benefit relates to improving the ease of maintaining and repairing the electrical devices and other electrical components of the temperature-controlled case. By moving electrical devices from the door to a location external thereto (e.g., compartment 30), one can more readily access the electrical components for maintenance or repair. Also, one does not have to dismantle and/or remove a door to perform these maintenance and repair operations. Rather, in the exemplary embodiment shown, one can simply move or remove the panel 34 from the compartment 30 to have direct access to the electrical device(s). Another, more general benefit is the decreased likelihood that something will go wrong with the door.

Each modular door system 14 includes a door rail 40 having a first horizontal rail element 42 generally opposite a second horizontal rail element 44, and a first vertical rail element 46 generally opposite a second vertical rail element 48 according to an exemplary embodiment. The modular door system 14 is configured to be pivotally coupled to the refrigerated case 10 at the refrigerated case frame 16. The first vertical rail element 46 pivots about a pivot axis 50 so that the second vertical rail element 48 is movable between an open position and a closed position. When the modular door system 14 is in the closed position, it acts as a barrier or thermal break between the interior space 12 of the refrigerated case 10 and the surrounding environment. When the modular door system 14 is in the open position, a customer or other user is able to access the goods disposed in the interior space 12 of the refrigerated case 10.

Referring to FIGS. 2-9, a spring-loaded pin assembly 100 and a door closing control 102 are shown configured to pivotally couple a modular door system 14 to the refrigerated case frame 16 according to an exemplary embodiment. The spring-loaded pin assembly 100 provides for coupling a first end 52 of the modular door system 14 to the refrigerated case frame 16. The door closing control 102 provides for coupling a second end 54 of the modular door system 14 to the refrigerated case frame 16.

The spring-loaded pin assembly 100 and the first element 144 of the door closing control 102 are shown in the form of cartridges or components that are removably receivable in a first receptacle 56 and a second receptacle 58, respectively, of the modular door system 14 according to an exemplary embodiment. The first receptacle 56 is shown defined generally in the first horizontal rail element 42 of the door frame 40. The second receptacle 58 is shown defined generally in the second horizontal rail element 44 of the door frame 40. Accordingly, the spring loaded pin assembly 100 and the first element 144 of the door closing control 102 are interchangeably receivable within the receptacles of the door rail, so that the door can be constructed as a universal door capable of being used in right-hand or left-hand application by interchanging assembly 100 and first element 144 from the top to the bottom, etc. According to other exemplary embodiments, however, the door closing control 102 and the spring-loaded pin assembly 100 may not be in the form of cartridges. For example, the spring-loaded pin assembly may be substantially integral with the door.

According to an alternative embodiment, the door closing control and the spring-loaded pin assembly need not be used in combination. Rather, other components or devices for pivotally coupling a door to a temperature-controlled case can replace (e.g., be used in lieu of, etc.) one of the door closing control and the spring-loaded pin assembly. According to other exemplary embodiments, more than two components or devices may be used to pivotally couple a door to a temperature-controlled case.

Figure 2:
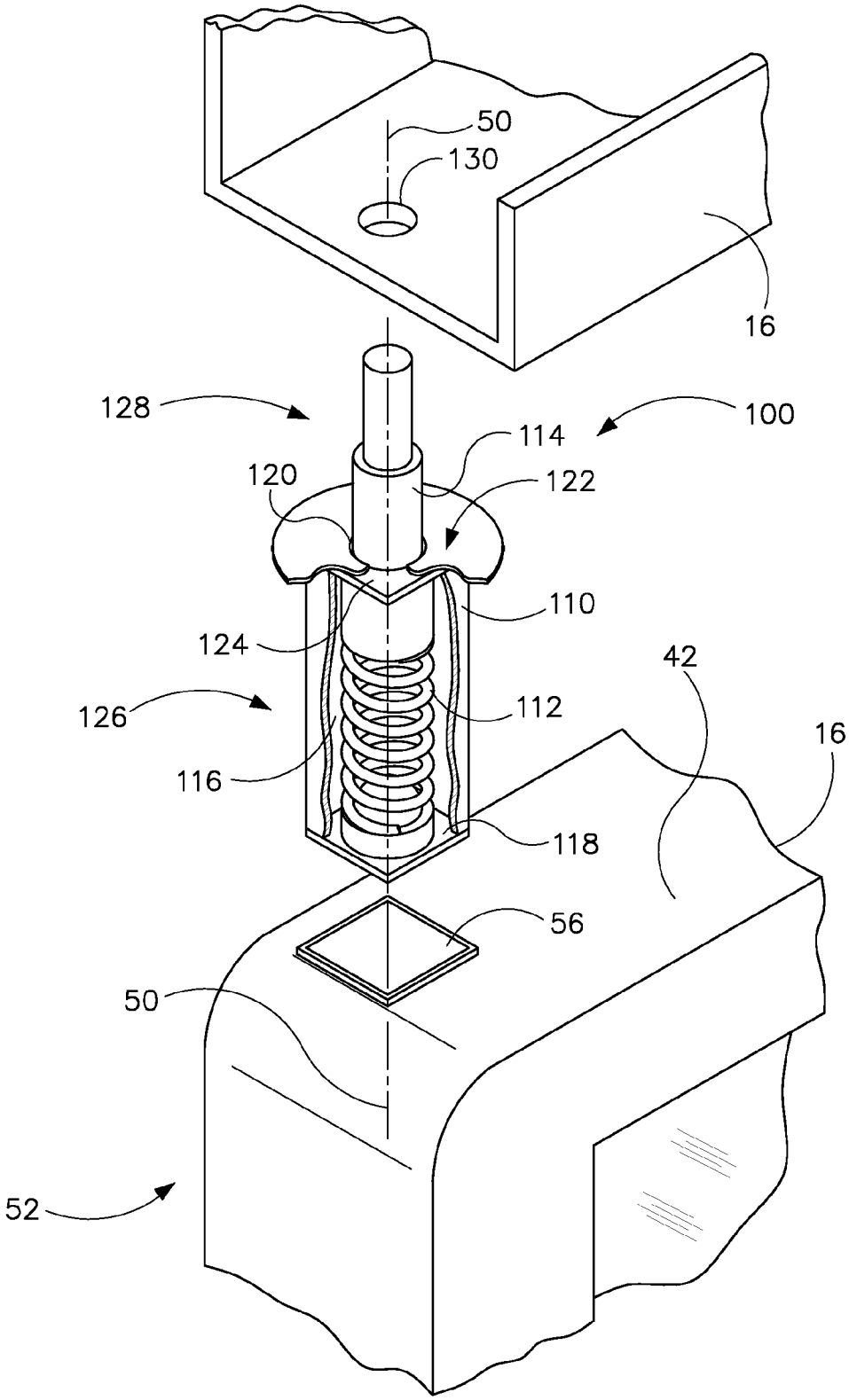
FIG. 2 is a partial, front perspective view of the temperature-controlled case according to the exemplary embodiment of FIG. 1 showing a spring-loaded pin assembly exploded therefrom.
Figure 3:
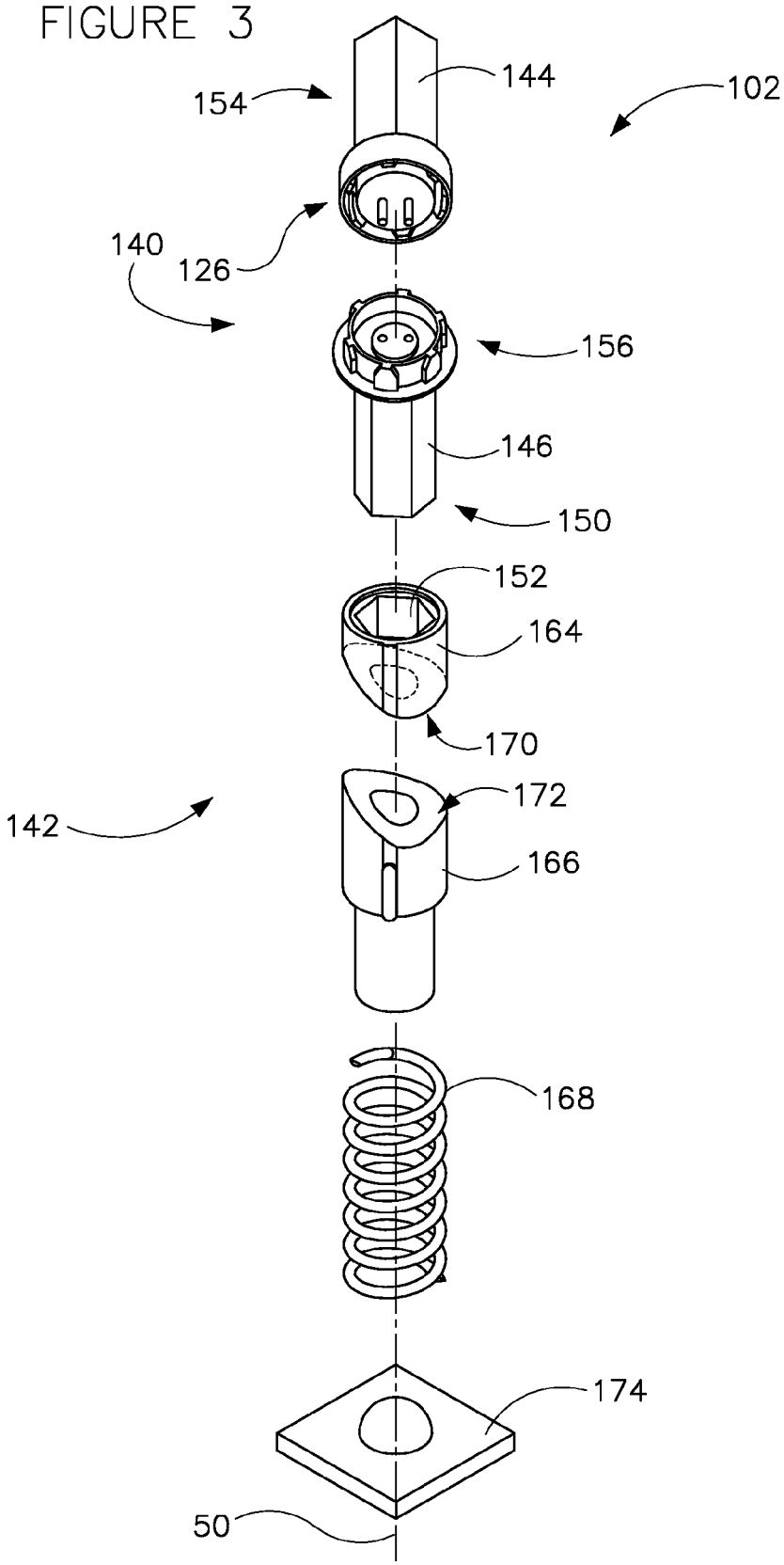
FIG. 3 is a partially-exploded view of the door closing control according to the exemplary embodiment of FIG. 1.

Referring to FIG. 2, the spring-loaded pin assembly 100 includes housing 110, a spring 112, and a pin 114 according to an exemplary embodiment. The spring-loaded pin assembly 100 is configured to facilitate coupling the first end 52 of the modular door system 14 to the refrigerated case frame 16. The spring-loaded pin assembly 100 is further configured to facilitate uncoupling the first end 52 of the modular door system 14 from the refrigerated case frame 16. The spring 112 is shown disposed within a cavity 116 defined by the housing 110, and generally between the pin 114 and a bottom wall 118 of the housing 110. The pin 114 is shown at least partially received in the cavity 116 of the housing 110 and substantially aligned with the spring 112 along an axis that is shown corresponding with the pivot axis 50 of the modular door system 14. Without the application of an outside force to the pin 114, the spring 112 biases the pin 114 upward and through an opening 120 in a top wall 122 of the housing 110 to an extended position. A lip 124 of the pin 114 prevents the pin 114 from being forced out of the opening 120 in the housing 110 by the spring 112. An outside force may be applied to the pin 114 to move the pin 114 from the extended position toward a retracted position, wherein the pin 114 is moved toward the bottom wall 118 of the housing 110 and further into the cavity 116. Once this outside force is removed, the pin 114 returns to the extended position as a result of the biasing force provided by the spring 112.

When coupling the first end 52 of the modular door system 14 to the refrigerated case frame 16, a first portion 126 of the spring-loaded pin assembly 100 is configured to be received in the first receptacle 56 and a second portion 128 of the spring-loaded pin assembly 100 is configured to operatively engage the refrigerated case frame 16 according to an exemplary embodiment. In the exemplary embodiment shown, the first portion 126 of the spring-loaded pin assembly 100 generally corresponds to the housing 110. The first portion 126 is typically disposed within the first receptacle 56 before the second portion 128 is engaged with the refrigerated case frame 16. Once the first portion 126 is disposed in the first receptacle 56, an outside force is typically applied (e.g., by a person's finger(s), by a tool, etc.) to the pin 114, moving it further into the housing 110 to allow the modular door system 14 to be moved upright (e.g., such that the pivot axis 50 is substantially vertical) without the pin 114 complicating the installation (e.g., by hitting the exterior of the refrigerated case frame). The pin 114 is intended to be substantially aligned with a receiving feature (e.g., a slot 130 in the header 22, discussed in more detail below) of the refrigerated case frame 16 when the modular door system 14 is in the desire position (e.g., upright). Removing the outside force from the pin 114 allows the pin 114 to return to the extended position and to engage the refrigerated case frame 16 at the receiving feature (e.g., by extending at least partially through slot 130) to pivotally couple the first end 52 of the modular door system 14 to the refrigerated case frame 16.

When uncoupling the first end 52 of the modular door system 14 from the refrigerated case frame 16, an outside force can be applied to the pin 114 to remove it from the receiving feature and move it further into the cavity 116. In this way, a clearance may be provided between the modular door system 14 and the refrigerated case frame 16, allowing the modular door system 14 to be moved relative thereto and/or removed therefrom.

Referring to FIGS. 3-8, the door closing control 102 is shown including a coupling device, shown as a torque transfer coupling 140, and a hinge 142 according to an exemplary embodiment. The door closing control 102 is configured to couple the second end 54 of the modular door system 14 to the refrigerated case frame 16. The door closing control 102 is further configured to bias the modular door system 14 toward the closed position once it is coupled to the refrigerated case frame 16.

Figure 4:
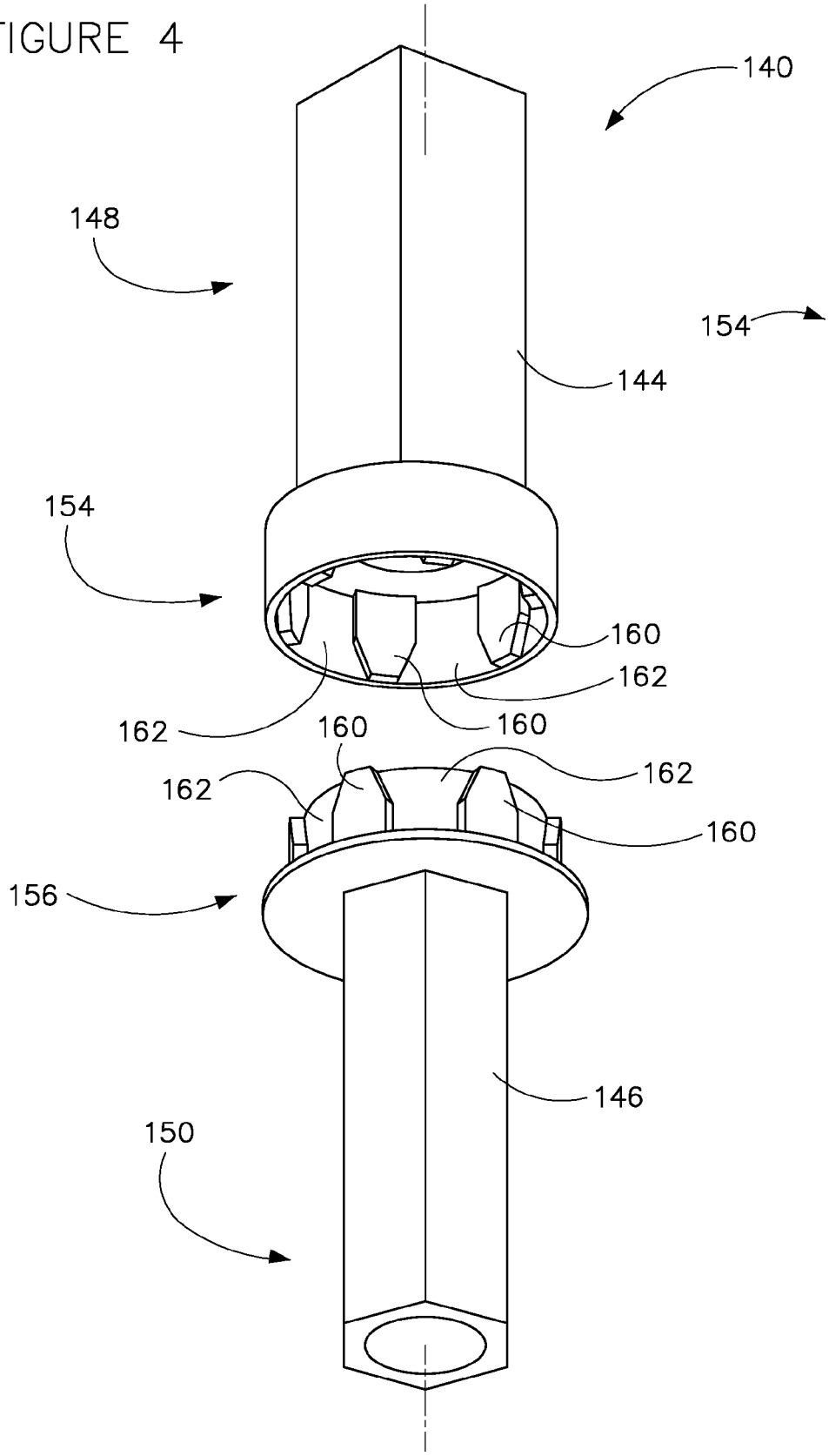
FIG. 4 is an exploded view of a torque transfer coupling of the door control system according to the exemplary embodiment of FIG. 3.

Referring to FIG. 4, the torque transfer coupling 140 includes a first element 144 removably coupleable with a second element 146 according to an exemplary embodiment. As will be discussed in more detail below, the torque transfer coupling 140 is configured to facilitate coupling the second end 54 of the modular door system 14 to the refrigerated case frame 16. The first element 144 of the torque transfer coupling 140 is configured to be coupled to the modular door system 14. The second element 146 of the torque transfer coupling 140 is configured to be coupled to the refrigerated case frame 16. Accordingly, by coupling the first element 144 and the second element 146, the modular door system 14 may be coupled to the refrigerated case frame 16, as will be discussed in more detail below.

Figure 5:
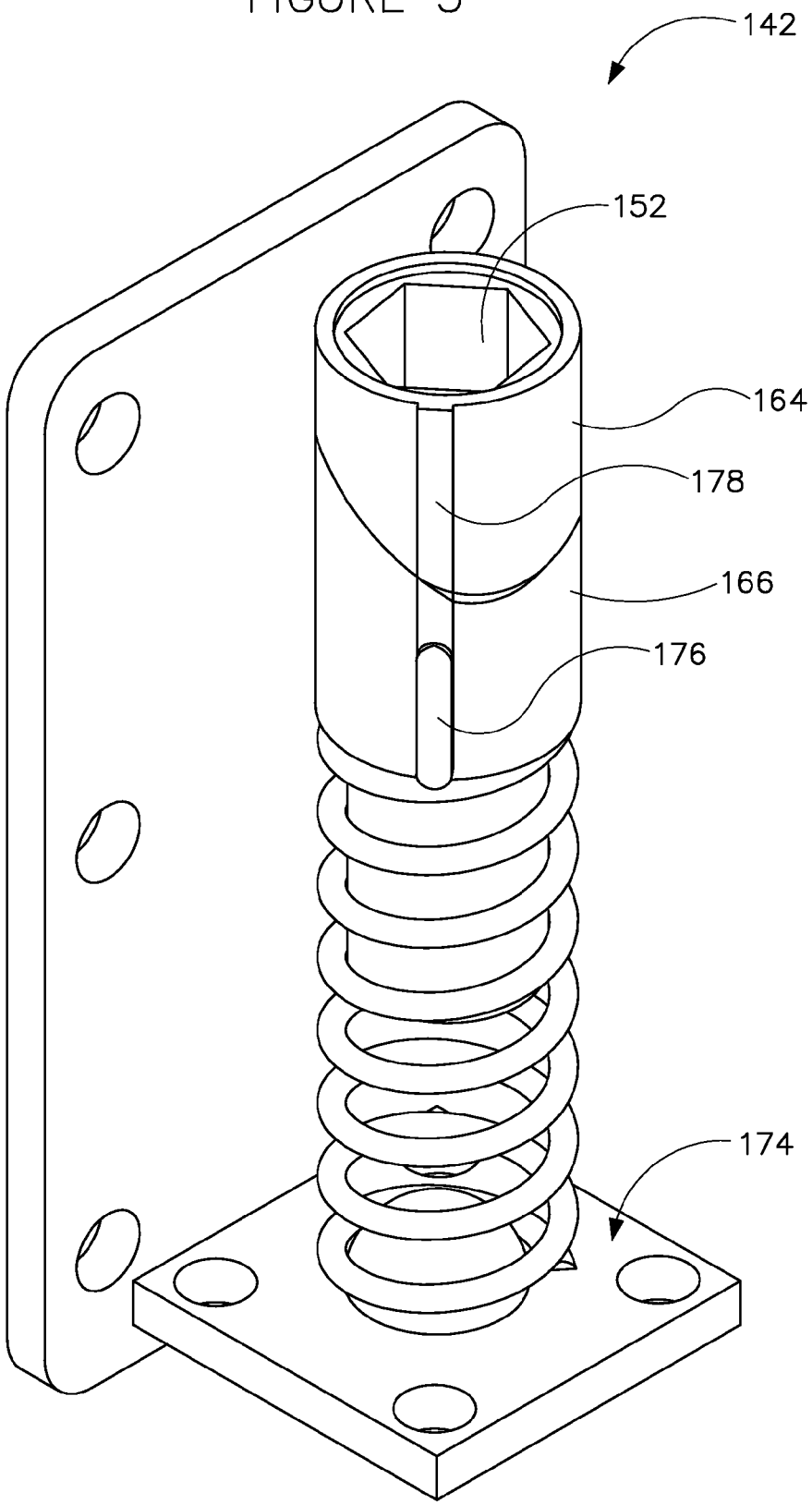
FIG. 5 is a perspective view of a hinge of the door control system according to the exemplary embodiment of FIG. 3.
Figure 6:
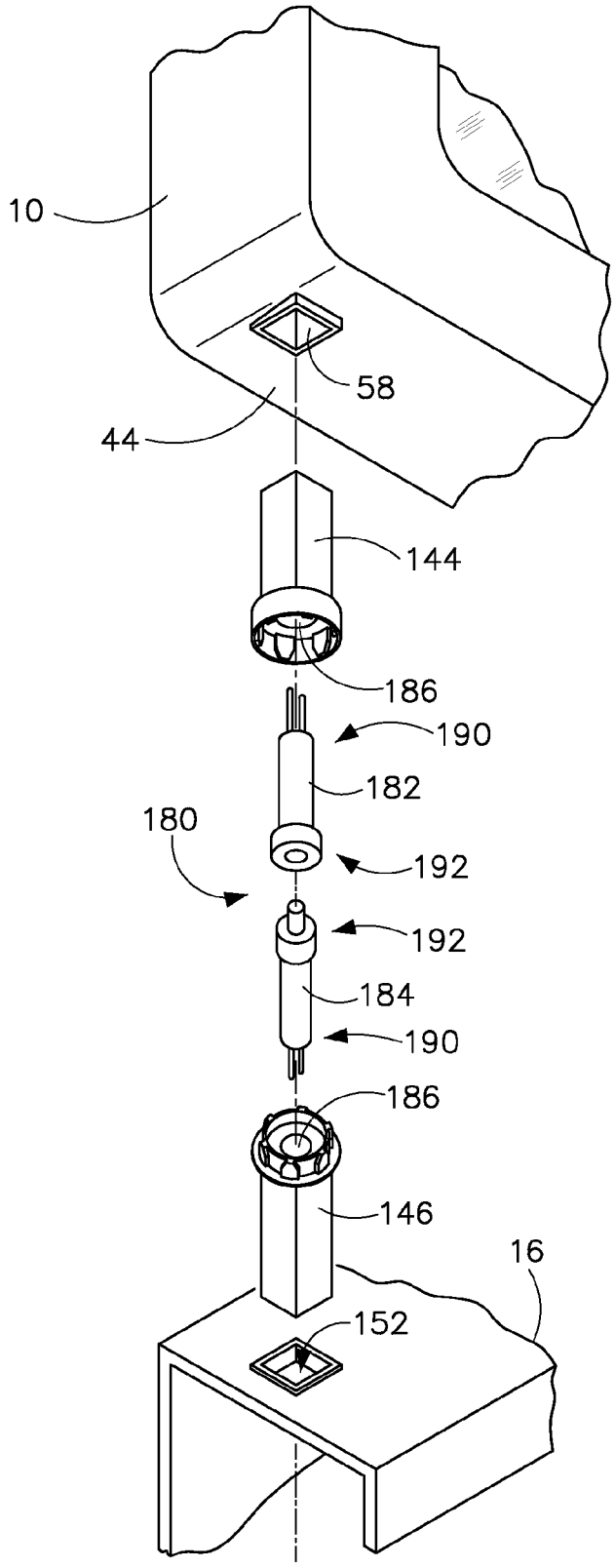
FIG. 6 is a partial, perspective view of the temperature-controlled case according to the exemplary embodiment of FIG. 1.
Figure 7:
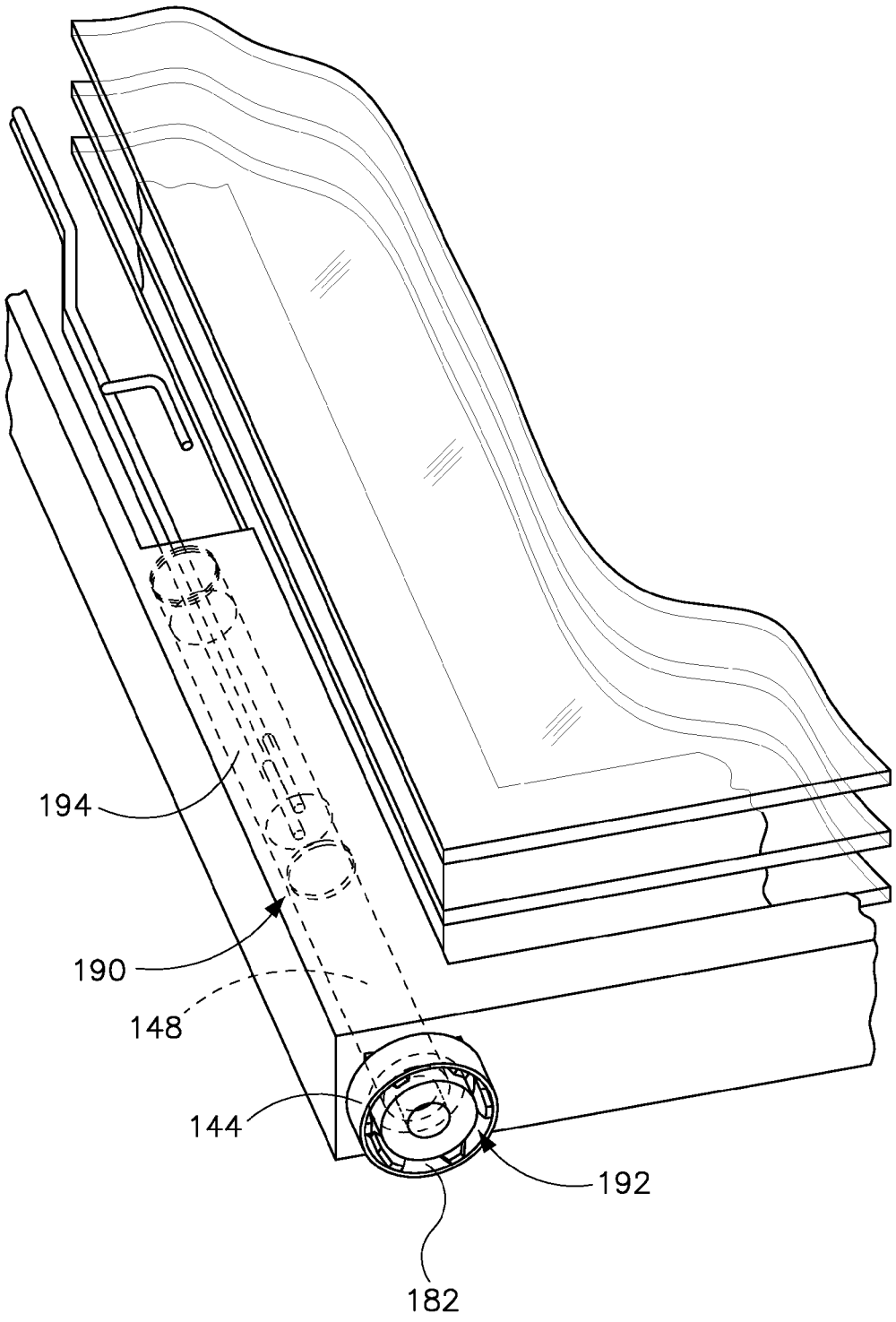
FIG. 7 is another partial, front perspective view of the temperature-controlled case according to the exemplary embodiment of FIG. 1 with the door frame removed for clarity.
Figure 8:
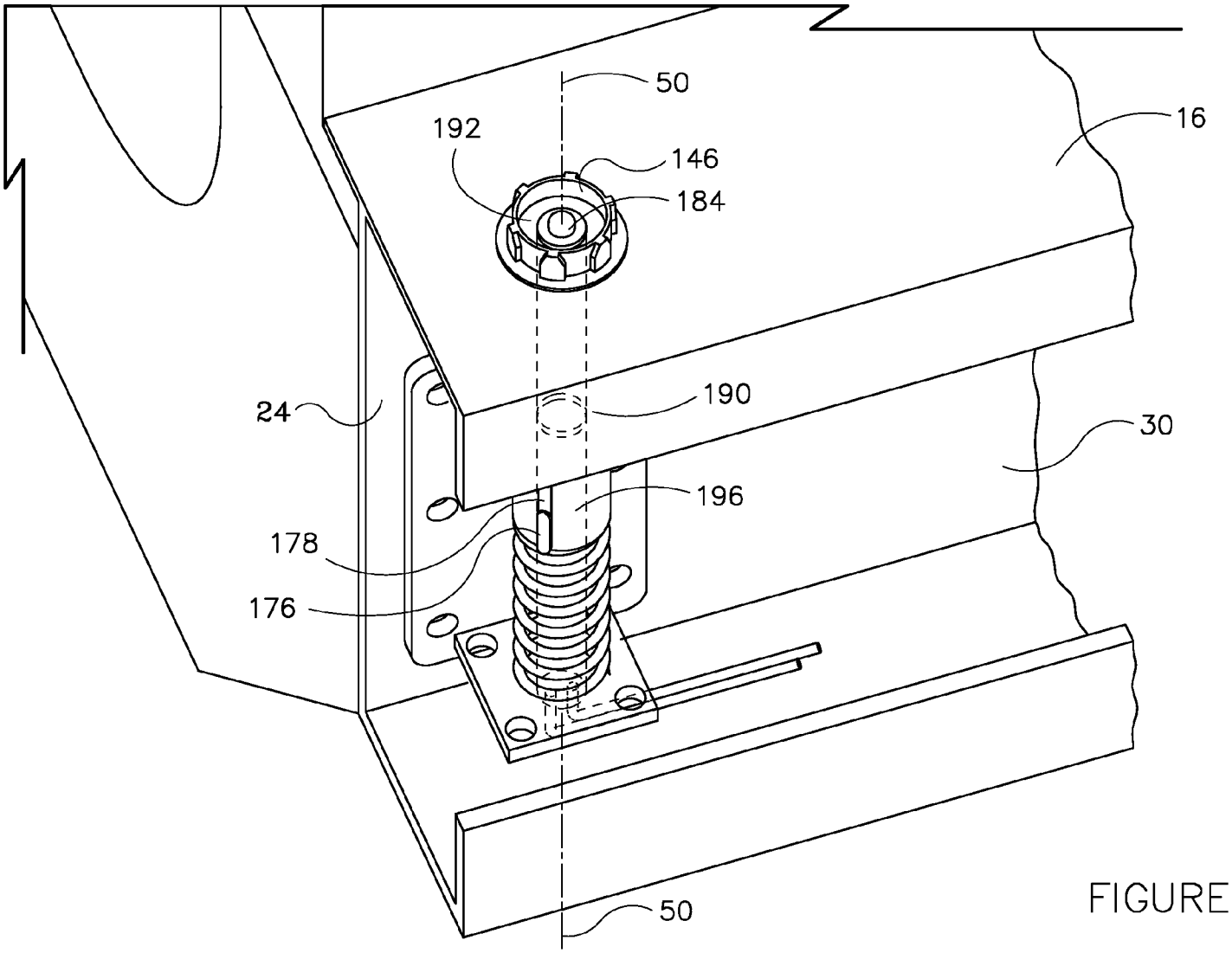
FIG. 8 is another partial, front perspective view of the temperature-controlled case according to the exemplary embodiment of FIG. 1.

Referring to FIGS. 7 and 8, how the torque transfer coupling facilitates coupling the second end 54 of the modular door system 14 to the refrigerated case frame 16 will now be discussed in more detail according to an exemplary embodiment. Referring to FIG. 7, to couple the first element 144 to the modular door system 14, a first portion 148 of the first element 144 is disposed in the second receptacle 58 of the modular door system 14 (see, e.g., FIG. 6 illustrating second receptacle 58). The first portion 148 is keyed to the second receptacle 58 such that the first element 144 substantially does not rotate relative to the modular door system 14. Referring to FIG. 8, to couple the second element 146 to the refrigerated case frame 16, a first portion 150 of the second element 146 is disposed in an aperture 152 (see, e.g., FIG. 5 illustrating aperture 152) extending through the hinge 142, which is shown disposed within and coupled to the refrigerated case frame 16. Referring back to FIGS. 7 and 8, after coupling the first element 144 to the modular door system 14 and the second element 146 to the refrigerated case frame 16, the first element 144 and the second element 146 of the torque transfer coupling 140 may be coupled in order to couple the modular door system 14 to the refrigerated case frame 16. A second portion 154 of the first element 144 is configured to at least partially receive a second portion 156 of the second element 146. A second portion 156 of the second element 146 is configured to be at least partially received within the second portion 154 of the first element 144. Positioning the second portion 156 of the second element 146 at least partially in the second portion 154 of the first element 144 couples the first element 144 to the second element 146, and, thereby, couples the second end 54 of the modular door system 14 to the refrigerated case frame 16. According to other exemplary embodiments, other suitable methods of coupling the first element and the second element may be utilized.

Referring further to FIGS. 7-8, the first element 144 and the second element 146 of the torque transfer coupling 140 are configured to be both annularly stacked and vertically aligned along a common axis, which is shown corresponding to the pivot axis 50 of the modular door system 14. This configuration provides for self-alignment of the first element 144 and the second element 146 during installation. Stated otherwise, the torque transfer coupling 140 allows one to install a door substantially without concerning themselves with the alignment of the first element 144 and the second element 146. It should be noted that, while the first element and the second element are shown aligned along the pivot axis 50 of a modular door system, the elements of the torque transfer coupling may also be aligned along an axis parallel to the pivot axis of the door according to some exemplary embodiments.

The torque transfer coupling 140 is further configured to transfer the pivotal motion of the modular door system 14 to the hinge 142 according to an exemplary embodiment. The first element 144 and the second element 146 of the torque transfer coupling 140 include a plurality of engagement features, shown as one or more keys 160 and keyways 162. The keys 160 (e.g., engagement lugs) are configured to be engagable with the keyways 162. As shown, the keys 160 engage the keyways 162 as the first element 144 is coupled to the second element 146. In addition to helping establish the alignment of the first element 144 and the second element 146 along a common axis, the interaction between the keys 160 and the keyways 162 substantially prevents the first element 144 and the second element 146 from rotating relative to one another. Accordingly, when the modular door system 14 is moved between the open position and the closed position, the interaction of the keys 160 and keyways 162 causes the motion of the first element 144, which is rotationally fixed relative to the modular door system 14, to be transferred to the second element 146. Further, because first portion 150 of the second element 146 of the torque transfer coupling 140 is at least partially received in and keyed at least in part to the aperture 152 of hinge 142, the pivotal motion of the torque transfer coupling 140 is transferred to at least a part of the hinge 142 (shown as first cam 164, which is discussed in more detail below). According to other exemplary embodiments, the engagement features may be any features suitable for helping to transfer motion from the first element to the second element of the torque transfer coupling and/or suitable for helping establish the alignment of the first element and the second element.

According to an alternative embodiment, the door closing control may not include a torque transfer coupling. In some alternative embodiments, torque transferring elements other than a torque transfer coupling may integrally formed with the door and/or frame (e.g., during manufacture). For example, a projection may be integrally formed to extend downward from the second end of the door to be directly received in the aperture 152 of the hinge.

Referring to FIG. 5, the hinge 142 includes a first portion, shown as the first cam 164, rotatable relative to a second portion, shown as a second cam 166, and a spring 168 according to an exemplary embodiment. The hinge 142 is coupled to the refrigerated case frame 16 and configured to transform pivotal motion into linear motion. The first cam 164, second cam 166, and spring 168 are aligned along common axis, shown corresponding with the pivot axis 50 of the modular door system 14. The aperture 152 of the hinge 142 extends substantially along the pivot axis 50 substantially through the first cam 164, the second cam 166, and the spring 168. When received in the aperture, the first portion 150 of the second element 146 of the torque transfer coupling 140 extends into the first cam 164, providing for the pivotal motion of the door to be transferred by the torque transfer coupling 140 to the first cam 164, as discussed above.

The first cam 164 includes a first cam surface 170 and the second cam 166 includes a second cam surface 172 according to an exemplary embodiment. The second cam surface 172 is biased into engagement with the first cam surface 170 by the spring 168. Both the first cam surface 170 and the second cam surface 172 are shown are at least partially defined as ellipses that are slidably engagable with one another. Both the first cam surface 170 and the second cam surface 172 are further shown inclined relative to the pivot axis 50 (e.g., like ramps). As illustrated, the first cam 164 is pivotable (e.g., rotatable) about the pivot axis 50 and the second cam 166 is substantially not pivotable (e.g., non-rotatable) about the pivot axis 50. When the first cam 164 is pivoted relative to the second cam 166, the first cam surface 170 and the second cam surface 172 slidably move relative to each other. The incline of the first cam surface 170 and the second cam surface 172 relative to the pivot axis 50 causes the relative positions of the first cam 164 and the second cam 166 along the pivot axis 50 to change as the first cam 164 is pivoted. Stated otherwise, the rotation of the first cam 164 either pushes the second cam 166 in a first direction generally away from the modular door system 14 (shown here as downward) or permits the second cam 166 to move in a second direction generally toward the modular door system 14 (shown here as upward) because of the interaction of the first cam surface 170 and the second cam surface 172. Note that this up-and-down motion along the pivot axis 50 may be guided by a projection 176 disposed in a slot 178 that extends parallel to the pivot axis 50, as shown in FIG. 5.

The position of the second cam 166 relative to the first cam 164 and the direction of its translational (e.g., linear) movement is configured to substantially correspond to the position and the movement of the modular door system 14.

As discussed above, the torque transfer coupling 140 is configured to transfer the pivotal motion of the modular door system 14 to the first cam 164 of the hinge 142. When the modular door system 14 is in the closed position, the second cam 166 is substantially at its closest portion to the modular door system 14. As the modular door system 14 is moved from the closed position to the open position, the first cam 164 is pivoted relative to the second cam 166 and applies a force to the second cam 166 that moves the second cam 166 in the first direction, away from the modular door system 14. When the modular door system 14 is fully opened, the second cam 166 is at its furthest location from the modular door system 14. The modular door system 14 is maintained in this position by the first cam 164, which is substantially held in place by other components of the temperature-controlled case 10. As the modular door system 14 is moved back towards the closed position from the open position, first cam 164 rotates about the pivot axis 50, changing the relative position of the first cam surface 170 and the second cam surface 172 and allowing the second cam 166 to move in the second direction, towards the modular door system 14, under the biasing force of the spring 168, as will be discussed in more detail below.

The spring 168 is shown disposed between the second cam 166 and another support surface 174 according to an exemplary embodiment. The spring 168 is configured to provide a force that operatively biases the modular door system 14 toward the closed position. In the exemplary embodiment shown, the spring 168 is pre-loaded so that it provides this biasing force both when the modular door system 14 is open and when the modular door system 14 is closed. While the discussion below will focus on the operation of a spring that has been pre-loaded, it should be recognized that the spring of the hinge need not be pre-loaded to provide many of the benefits disclosed herein.

Movement of the second cam 166 along the pivot axis 50 changes the distance the spring 168 is compressed according to an exemplary embodiment. When the modular door system 14 is closed, the spring 168 is typically compressed a distance that is at or near the minimum distance that the spring 168 is compressed during operation of the modular door system 14. As the modular door system 14 is opened (e.g., moved away from the closed position), the distance the spring 168 is compressed progressively increases. When the modular door system 14 is in its fully opened position, the spring 168 is compressed a distance that is at or near the maximum distance that the spring 168 is compressed during operation of the modular door system 14. Accordingly, the farther the second cam 166 is from the modular door system 14, the greater the compression of the spring 168 and the greater magnitude the biasing force provided by the spring 168.

The biasing force provided by the spring 168 is transferred to the modular door system 14 by the second cam 166, the first cam 164, and the torque transfer coupling 140 according to an exemplary embodiment. The biasing force provided by the spring 168 is generally directed in the second direction, here, upward and toward the modular door system 14. The spring 168, which is in contact with the second cam 166 at one end, biases the second cam 166 in the second direction substantially at all times. As the second cam 166 is biased toward the modular door system 14, interaction of the second cam surface 172 with the first cam surface 170 biases the first cam 164 to pivot in a direction corresponding to moving the modular door system 14 from the open position toward the closed position (here, counterclockwise). As the first cam 164 is coupled to the modular door system 14 by the torque transfer coupling 140 and substantially not pivotable relative thereto, the biasing force experienced by the first cam 164 is transferred to the modular door system 14 by the torque transfer coupling 140. That is, the first cam 164 operatively biases the modular door system 14 to pivot in a direction corresponding to moving the modular door system 14 from the open position toward the closed position. In this way, the hinge 142 helps prevent the modular door system 14 from being left open, preventing the loss of chilled or cooled air and improving the energy efficiency of the refrigerated case 10. Also in this way, the hinge 142 helps control the motion of the modular door system 14 as it moves from the open position toward the closed position.

Referring to FIGS. 7-8, an electrical connectivity system 180 is shown that includes at least a first electrical connector 182 removably coupleable to a second electrical connector 184 according to an exemplary embodiment. The electrical connectivity system 180 is configured to provide an electrical connection between the modular door system 14 of the temperature-controlled case and one or more electrical devices external thereto. The first electrical connector 182 of the electrical connectivity system 180 is configured to be mechanically and electrically coupled to the modular door system 14. The second electrical connector 184 of the electrical connectivity system 180 is configured to be mechanically coupled to the refrigerated case frame 16 and electrically coupled to the electrical components of the refrigerated case 10 external to the modular door system 14. Accordingly, by coupling the first electrical connector 182 and the second electrical connector 184, the modular door system 14 may be electrically coupled to electrical components of the refrigerated case 10 external to the modular door system 14 (e.g., housed in or coupled to the refrigerated case frame 16, such as in compartment 30).

Referring further to FIGS. 6-8, coupling the first element 144 of the torque transfer coupling and the second element 146 of the torque transfer coupling 140 is configured to also couple the first electrical connector 182 and the second electrical connector 184 according to an exemplary embodiment. The first element 144 and the second element 146 of the torque transfer coupling 140 each include a centrally-located cavity 186, shown aligned along the pivot axis 50. These centrally-located cavities 186 are configured to at least partially receive the first electrical connector 182 and the second electrical connector 184. FIG. 7 shows the first electrical connector 182 at least partially disposed within the centrally-located cavity 186 of the first element 144. FIG. 8 shows the second electrical connector 184 at least partially disposed within the centrally-located cavity 186 of the second element 146. When disposed within the centrally-located cavities 186, the first electrical connector 182 is annularly aligned with the first element 144 of the torque transfer coupling 140 and second electrical connector 184 is annularly aligned with the second element 146 of the torque transfer coupling 140.

Referring to FIGS. 7-8, the first electrical connector 182 and the second electrical connector 184 are formed from an electrically conductive material (e.g. metal, etc.) and overmolded into an electrically insulative sleeve (e.g. plug, etc. formed from a resilient material such as rubber or the like), which may be formed with an external collar (e.g. rib, shoulder, etc.). The first electrical connector 182 and the second electrical connector 184 are disposed within the centrally-located cavities 186 of the first element 144 and the second element 146 of the torque transfer coupling 140 according to an exemplary embodiment, such as by inserting (e.g. press-fitting, etc.) the connectors into the cavities, such that the connectors may retained in the cavities by the collar or rib. Overmolding the first and second electrical connectors 182, 184 into the plugs or sleeves that are then preassembled into the cavities of the first and second elements 144, 146 of the torque transfer coupling 140 in advance of installation provides a number of benefits, including, but not limited to, avoiding the steps of inserting and securing the first and second electrical connectors 182, 184 to the first and second elements 144, 146 of the torque transfer coupling 140 during installation of the door 14 onto the frame 16 of the case. According to some exemplary embodiments, other ways of securing the electrical connectors to the elements of the torque transfer coupling in advance of installation may be used (e.g., adhesives, threaded connectors, etc.). According to other exemplary embodiments, any suitable method for substantially securing the electrical connectors relative to the elements of the coupling device may be used before or during or after installation. Referring to FIG. 6, the overmolded first and second electrical connectors 182, 184 are shown exploded from the first element 144 and the second element 146 to more clearly illustrate the features and manner of coupling those components. It should be noted that one or more of the electrical connectors (e.g., the first and the second electrical connectors) may be considered part of the door closing control.

Referring further to FIGS. 7-8, coupling the first element 144 of the torque transfer coupling 140 to the modular door system 14 also couples the first electrical connector 182 to the modular door system, and coupling the second element 146 of the torque transfer coupling 140 to the refrigerated case frame 16 also couples the second electrical connector 184 to the refrigerated case frame 16 according to an exemplary embodiment. As discussed above, the first electrical connector 182 is formed from an electrically conductive material (e.g. metal, etc.) and is overmolded into an electrically insulative sleeve (e.g. plug, etc. formed from a resilient material such as rubber or the like), which may be formed with an external collar (e.g. rib, shoulder, etc.). The first electrical connector 182 and the second electrical connector 184 are disposed within the centrally-located cavity 186 of the first element 144 and the second element 146 before installation. The centrally-located cavities 186 are shown extending through the first and second elements 144, 146 of the torque transfer coupling 140 such that a first end 190 and a second end 192 of each of the first and second electrical connectors 182, 184 are accessible for coupling. The first end 190 of the first electrical connector 182 is configured to be coupled to the electrical components of the modular door system 14. As the first portion 148 of the first element 144 of the torque transfer coupling 140 is disposed in the second receptacle 58 of the modular door system 14, the first end 190 of the first electrical connector 182 is coupled to the electrical components of the modular door system 14 (e.g., by a connection formed with a third electrical connector 194 within the modular door system 14 as shown in FIG. 7). Similarly, the first end 190 of the second electrical connector 184 is configured to be coupled to the electrical components external to the modular door system 14, shown disposed within the compartment 30 at least partially defined by the sill 24 of the refrigerated case frame 16. As the first portion 150 of the second element 146 of the torque transfer coupling 140 is disposed in an aperture 152 extending through the hinge 142, the first end 190 of the second electrical connector 184 is coupled to the electrical components external to the modular door system 14 (e.g., by a connection formed with a fourth electrical connector 196 that is also at least partially disposed within the aperture 152 of the hinge 142 as shown in FIG. 8).

Referring further to FIGS. 7-8, as the first element 144 and the second element 146 of the torque transfer coupling 140 are coupled, so are the first electrical connector 182 and the second electrical connector 184 of the electrical connectivity system 180. The second ends 192 of the first electrical connector 182 and the second electrical connector 184 are configured to be removably coupled to one another. As the second portion 156 of the second element 146 of the torque transfer coupling 140 is at least partially received within the second portion 154 of the first element 144 of the torque transfer coupling 140, the second end 192 of the first electrical connector 182 is guided into coupling engagement with the second end 192 of the second electrical connector 184. Accordingly, an electrical and mechanical coupling of the modular door system 14 and the refrigerated case frame 16 are substantially simultaneously achieved in a plug-and-play manner. It should be noted that, like the first and second elements 144, 146 of the torque transfer coupling 140, the first and second electrical connectors 182, 184 are vertically stackable, and, accordingly, substantially self-align during installation.

In the exemplary embodiment shown, the fourth electrical connector 196 is electrically coupled to the electrical devices 32 in the compartment 30. So, when the modular door system 14 is coupled to the refrigerated case frame 16, the modular door system 14 is electrically coupled to the electrical devices 32 in the compartment 30. As discussed above, with this configuration, the modular door system 14 can maintain its electrical functionalities without the electrical devices being included or integrated therein.

According to an alternative embodiment, coupling the torque transfer coupling does not also couple the electrical connectors. Stated otherwise, the electrical connectors may be coupled independently of coupling the elements of the torque transfer coupling 140.

An exemplary method of mechanically and electrically installing a door of a temperature-controlled case will now be discussed by way of example and not by way of limitation.

Referring to FIGS. 1-8, the second end 54 of the modular door system 14 is intended to be coupled to the refrigerated case frame 16 before the first end 52 of the modular door system 14 according to an exemplary embodiment.

To couple the second end 54 of the modular door system 14 to the refrigerated case frame 16, the first element 144 of the torque transfer coupling 140 is disposed within the second receptacle 58 of the modular door system 14 and the second element 146 of the torque transfer coupling 140 is disposed within the aperture 152 extending through the hinge 142. The modular door system 14 is then positioned to couple the first element 144 and the second element 146 of the torque transfer coupling 140. The first element 144 and the second element 146 self-align as the second element 146 is at least partially received within the first element 144, coupling the second end 54 of the modular door system 14 to the refrigerated case frame 16. As discussed above, coupling the first element 144 and the second element 146 of the torque transfer coupling 140 also couples the first electrical connector 182 and the second electrical connector 184 of the electrical connectivity system 180. In this way, an electrical connection is formed between the modular door system 14 and the electrical devices 32 disposed in the compartment 30 and/or at other locations external to the modular door system 14. It should be noted that, according to some exemplary installation methods, the first element 144 of the torque transfer coupling 140 may be pre-assembled with the door and/or the second element 146 of the torque transfer coupling 140 may be pre-assembled with the hinge 142 (e.g., at the factory).

After coupling the second end 54 of the modular door system 14 to the refrigerated case frame 16, the first end 52 of the modular door system 14 is coupled to the refrigerated case frame 16 according to an exemplary embodiment. The spring-loaded pin assembly 100 is disposed within the first receptacle 56 of the modular door system 14. A force is applied to the pin 114 to move the pin 114 further into the cavity 116 of the housing 110 of the spring-loaded pin assembly 100, facilitating clearing the header 22 of the refrigerated case frame 16 in order to position the pin 114 to be received within the slot 130. The force applied to the pin 114 is removed to allow the pin 114 to extend at least partially through the slot 130, coupling the first end 52 of the modular door system 14 to the refrigerated case frame 16.

FIGS. 9-12 show a tool 200 that is a multi-functional (e.g., all-in-one) tool that is configured to improve the ease of installation of the modular door system 14 according to an exemplary embodiment. Once the refrigerated case frame 16 is assembled, one can couple the modular door system 14 to the refrigerated case frame 16 using only the tool 200. In the exemplary embodiment shown, this means that the tool 200 is configured to help pre-load the door closing control 102, to engage the spring-loaded pin assembly 100, and to engage a door squaring mechanism 202. Each of these capabilities/functions of the tool 200 will be discussed in more detail below.

Figure 9:
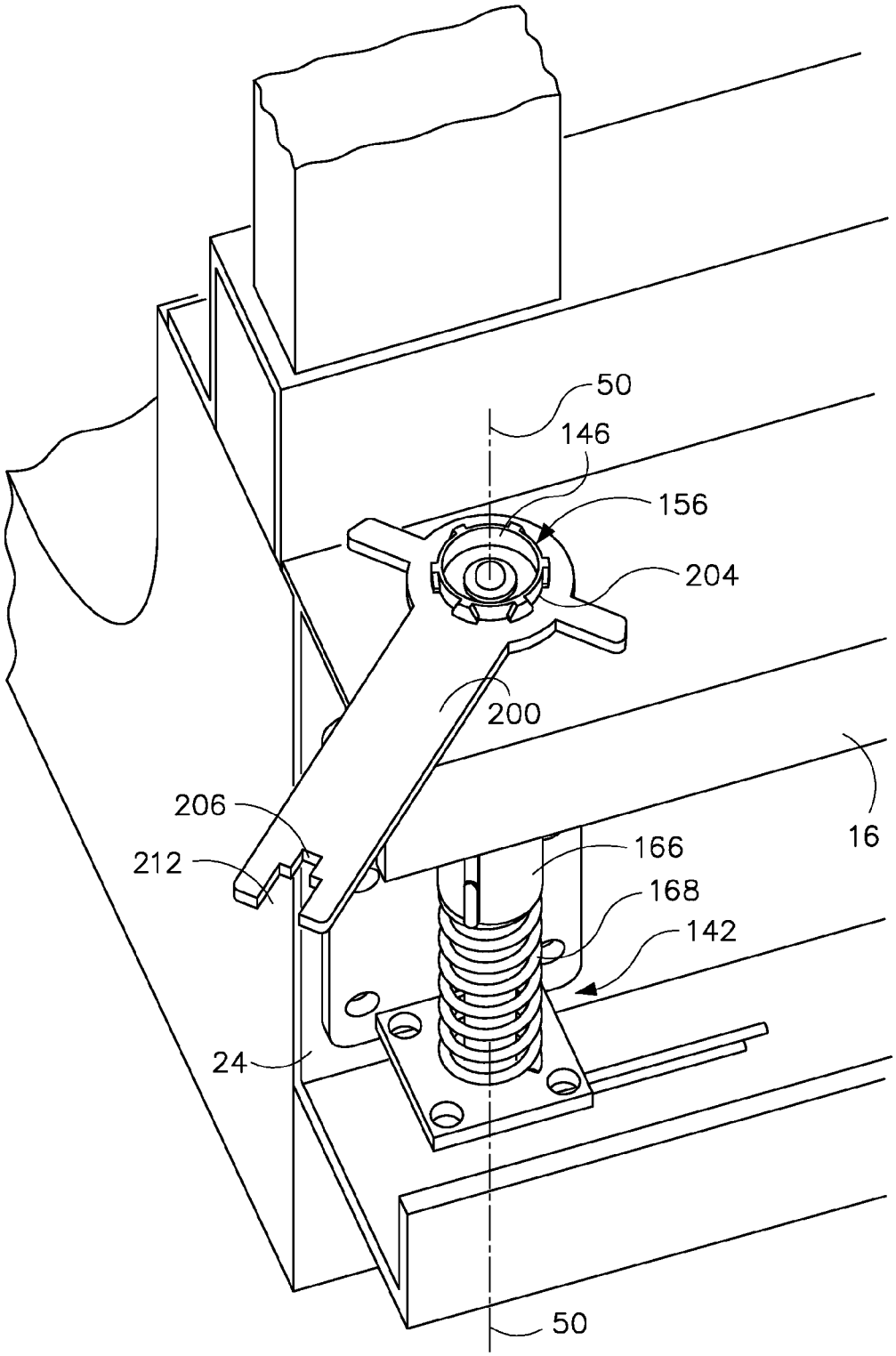
FIG. 9 is a another partial, front perspective view of the temperature-controlled case according to the exemplary embodiment of FIG. 1.

Referring to FIG. 9, the tool 200 is shown including a door control device engaging feature shown as an aperture 204 according to an exemplary embodiment. The aperture 204 is configured to help pre-load the door closing control 102. As discussed above, by pre-loading the door closing control 102, the modular door system 14 may be biased towards the closed position when the modular door system 14 is both in the open position and in the closed position. To pre-load the door closing control 102, the aperture 204 is disposed at least partially about the second portion 156 of the second element 146 of the torque transfer coupling 140, the second element 146 having already been disposed at least partially within the aperture 152 of the hinge 142. The tool 200 is then pivoted about the pivot axis 50 in the direction corresponding to moving the door from the closed position to the open position (clockwise as shown in FIG. 9). The aperture 204, shown keyed to the second portion 156 of the second element 146, causes the second element 146 to pivot about the pivot axis 50 in the same direction. As a result of the rotation of the second element 146, the first cam 164 rotates relative to the second cam 166, applying a force to the second cam 166 that moves the second cam 166 downward and compresses the spring 168 a distance. With the spring 168 compressed, the modular door system 14 can be installed such that the spring 168 is maintained in a constant state of compression. As discussed above, with the spring 168 in a constant state of compression, the modular door system 14 will be biased towards the closed position substantially at all times when it is coupled to the refrigerated case frame 16. According to other exemplary embodiments, other tools and/door techniques suitable for pre-loading the door control device may be used.

Figure 10:
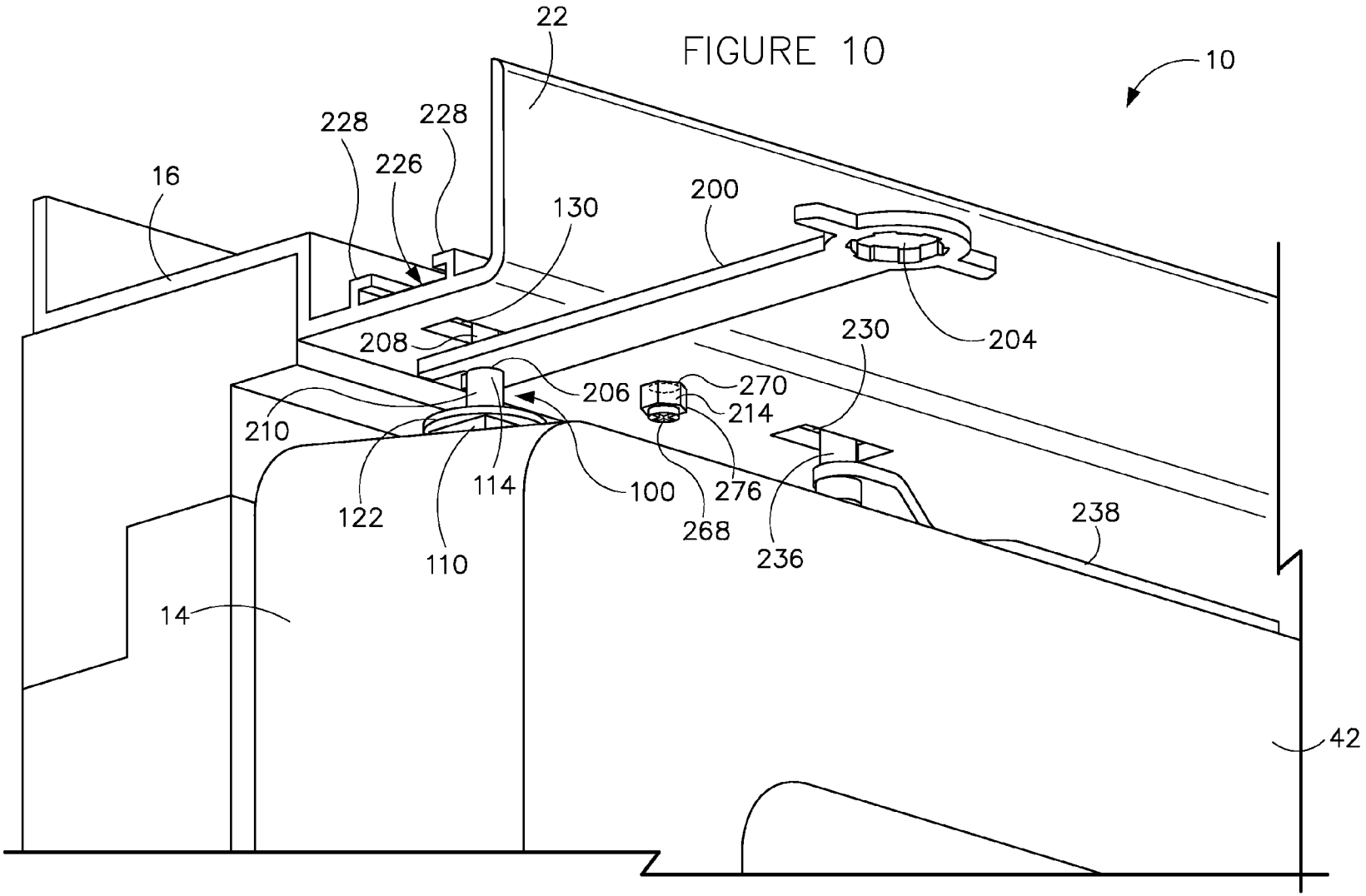
FIG. 10 is another partial, front perspective view of the temperature-controlled case according to the exemplary embodiment of FIG. 1.

Referring to FIG. 10, the tool 200 is shown further including a spring-loaded pin engagement feature shown as a first slot 206. The first slot 206 is configured to at least partially receive the pin 114 and to facilitate pushing the pin 114 toward the refracted position. In the exemplary embodiment shown, the pin 114 is tiered. Stated otherwise, the pin 114 is shown including a first portion 208 having a cross-section smaller than the cross section of a second portion 210. The first portion 208 is shown distal to the bottom wall 118 of the housing 110 relative to the second portion 210. The first slot 206 is shown configured to be slidably positioned about the first portion 208 of the pin 114 from above or from the side. When positioned about the first portion 208 of the pin 114, the tool 200 may be moved toward the bottom wall 118 of the housing 110 of the spring-loaded pin assembly 100 (here, downward) to help move the pin 114 toward the retracted position. As the tool 200 is moved downward, the tool 200 will encounter the second portion 210 of the pin 114, pushing it downward and into the cavity 116 of the spring-loaded pin assembly 100 and taking the first portion 208 of the pin with it. With the pin 114 disposed further into the housing 110, it is generally easier to move the spring-loaded pin assembly 100 into alignment with the receiving feature of the refrigerated case frame 16 during installation. According to some exemplary embodiments, the pin is not tiered, but, rather, includes another feature that facilitates moving the pin further into the cavity (e.g., a lip, a graduated cross-section, etc.). According to some exemplary embodiments, the configuration of the slot in the tool may vary to accommodate different pin configurations.

Figure 11:
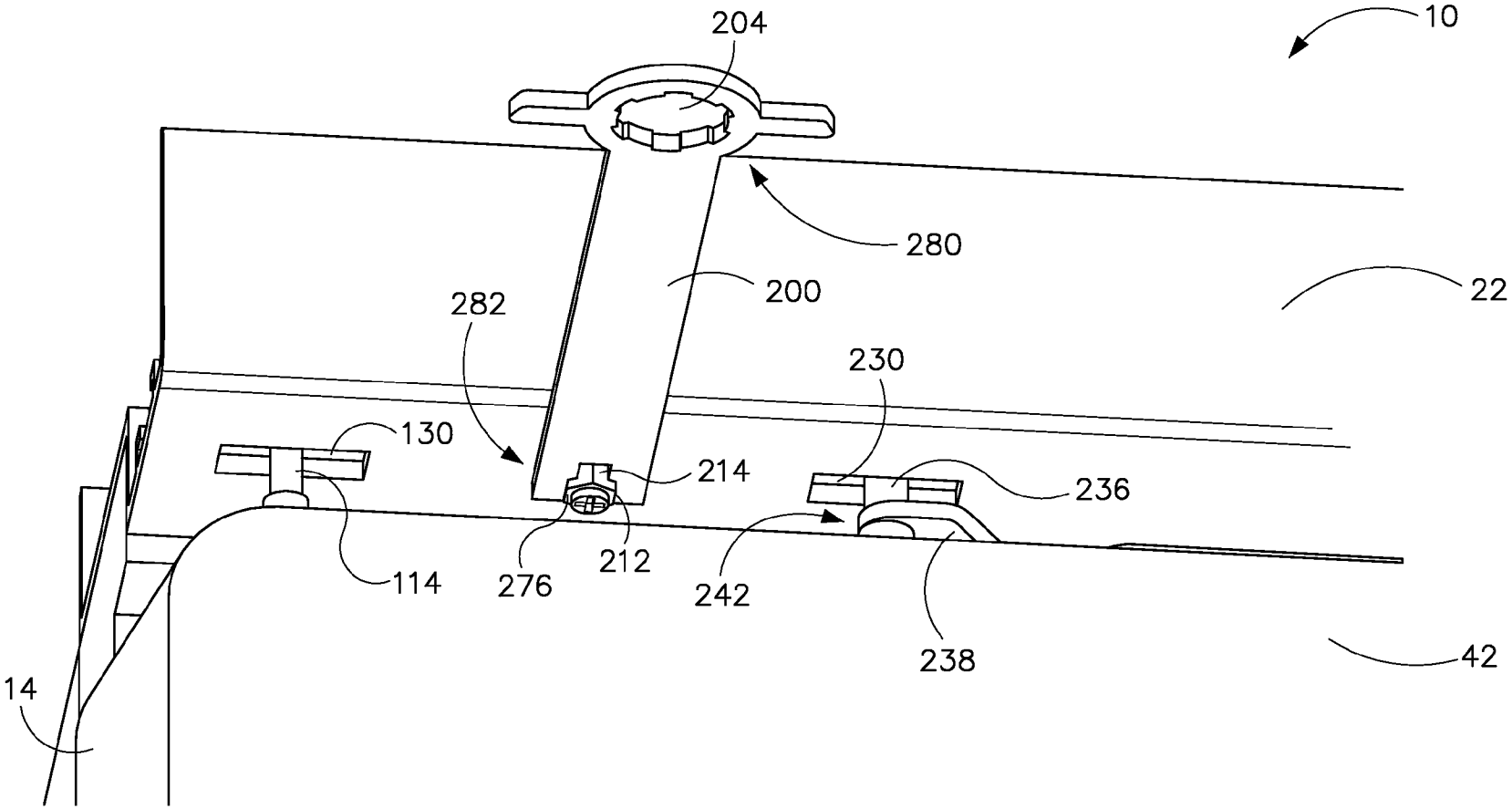
FIG. 11 is another partial, front perspective view of the temperature-controlled case according to the exemplary embodiment of FIG. 1.
Figure 12:
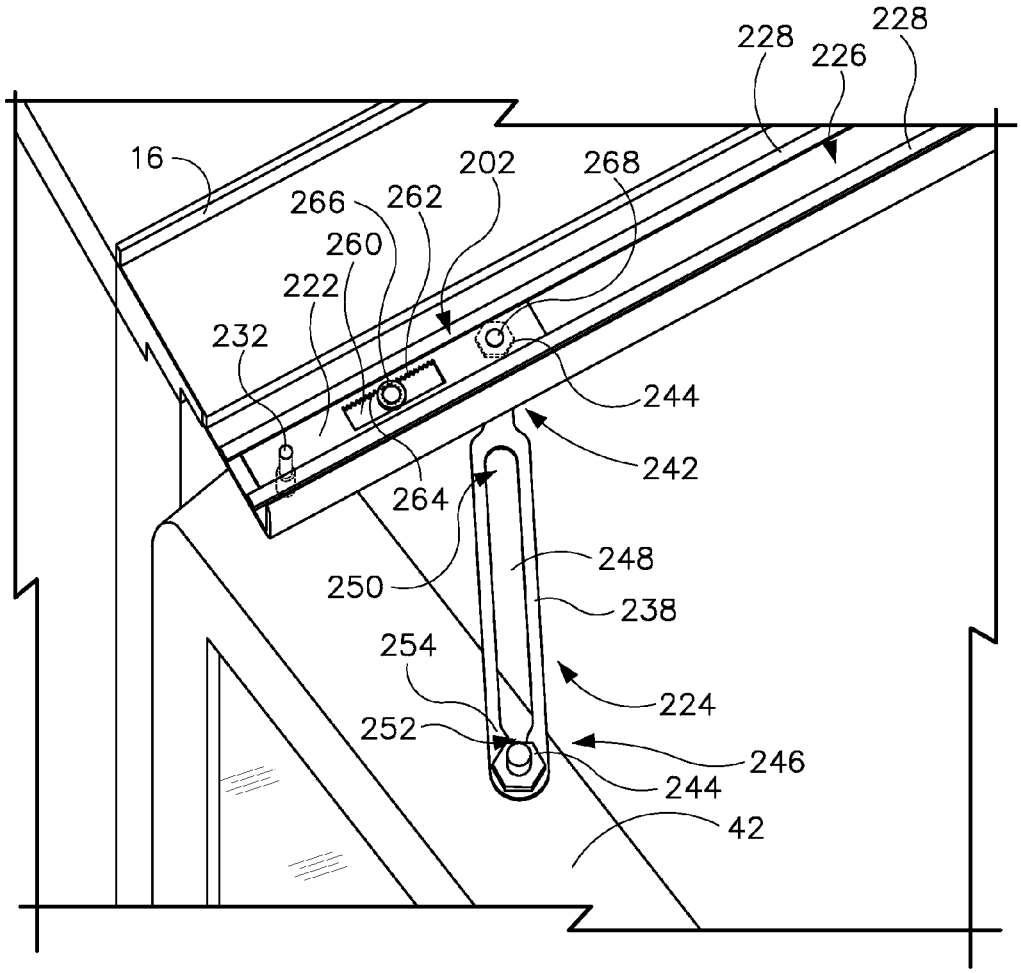
FIG. 12 is another partial, front perspective view of the temperature-controlled case according to the exemplary embodiment of FIG. 1.

Referring to FIGS. 11-12, the tool 200 is shown further including a door squaring mechanism engagement feature shown as a second slot 212. The second slot 212 is configured to engage an adjustment feature 214 of a door squaring mechanism 202 to facilitating squaring the modular door system 14 relative to the refrigerated case frame 16. Typically, squaring is performed after the first end 52 and the second end 54 of the modular door system 14 have been coupled to the refrigerated case frame 16. It should be noted, however, that adjustments be made using the door squaring mechanism at any time before, during, or after installation.

Referring further to FIGS. 11-12, the door squaring mechanism 202 includes a plate 222, a hold-open linkage 224, and the adjustment feature 214 according to an exemplary embodiment. It should be noted, however, that the hold-open linkage 224 may be considered to be independent of the door squaring mechanism.

The plate 222 is shown disposed on top of a laterally-extending, horizontal surface 226 of the header 22 between a pair of guide portions 228 according to an exemplary embodiment.

The guide portions 228 prevent undesirable front-to-back movement of the plate 222 relative to the refrigerated case frame 16. The position of the plate 222 generally corresponds to the locations of the receiving features for the spring-loaded pin assembly 100 and the hold-open linkage 224 in the horizontal surface 226 of the header 22, shown as laterally-extending slots 130 and 230, respectively. The plate 222 includes three apertures according to an exemplary embodiment. A first aperture 232 is substantially aligned with slot 130 and is configured to receive the pin 114 of the spring-loaded pin assembly 100 after the pin 114 passes through the slot 130 according to an exemplary embodiment. The first aperture 232 is sized and shaped to substantially correspond to the size and shape of the first portion 208 of the pin 114. This configuration substantially fixes the pin 114 both laterally and from front-to back relative to the plate 222 when received in the first aperture 232. Accordingly, while the pin 114 is laterally movable relative to the slot 130, lateral movement of the pin 114 relative to the slot 130 generally also requires lateral movement of plate 222 relative to the slot 130.

A second aperture 234 is substantially aligned with slot 230 and is configured to receive a first coupling element 236 of the hold-open linkage 224 according to an exemplary embodiment. The hold-open linkage 224 is shown including a plate 238, the first coupling element 236, and a second coupling element 240. A first portion 242 of the plate 238 is shown pivotally coupled to the header 22 of the refrigerated case frame 16 by the first coupling element 236, which extends through the slot 230 and the second aperture 234. A nut 244 is shown used to help keep the first coupling element 236, and thereby the first portion 242 of the plate 238, in the desired position. The second aperture 234 is shown sized and shaped to substantially correspond to the size and shape of the first coupling element 236, substantially fixing the first coupling element 236 laterally and from front-to-back relative to the plate 238 when it is received in the second aperture 234. Accordingly, similar to the pin 114, while the first coupling element 236 is laterally movable relative to the slot 230, lateral movement of the pin 114 relative to the slot 230 generally also requires lateral movement of plate 238 relative to the slot 230.

A second portion 246 of the plate 238 is shown pivotally and slidably coupled to the first horizontal rail element 42 of the modular door system 14 by the second coupling element 240. The second coupling element 240 is shown received through a slot 248 in the plate 238. While the second coupling element 240 is substantially fixed relative to the first horizontal rail element 42, the slot 248 is configured to provide for the plate 238 to be both pivotally moved and slidably moved relative to the second coupling element 240.

When the modular door system 14 is in the closed position, the plate 238 of the hold-open linkage 224 is generally laterally aligned with the first horizontal rail element 42 and the second portion 246 of the plate 238 is distal to the pivot axis 50 relative to the first portion 242 of the plate 238. In this position, the second coupling element 240 is generally at a first end 250 of the slot 248. As the modular door system 14 is moved between the open position and the closed position, the plate 238 pivots relative to the second coupling element 240 and the second coupling element 240 slides within the slot 248 from a position at or near the first end 250 of the slot 248 towards a second end 252 of the slot 248 distal to the first end 250. When the second coupling element 240 reaches the second end 252 of the slot 248, the modular door system 14 is substantially prevented from being pivotally moved any farther from the closed position. Also, at this position, the second coupling feature 240 has moved beyond a catching portion 254, configured to restrict the slidable movement the second coupling element 240 within the slot 248. The second coupling element 240 is prevented from moving back towards the first end 250 of the slot 248 in order to hold the modular door system 14 in or near the fully open position. The modular door system 14 will remain substantially at or near the fully open position until a force is applied to the modular door system 14 in the direction to move the modular door system 14 from the open position to the closed position that is sufficient to move the second coupling element 240 past the catching portion 254.

A third aperture 260 in the plate 222 of the door squaring mechanism 202 extends a distance laterally between the first aperture 232 and the second aperture 234 according to an exemplary embodiment. The third aperture 260 is shown including at least one laterally-extending side 262 having a plurality of teeth 264. The teeth 264 are configured to engage a plurality of teeth 266 of the adjustment feature 214. The adjustment feature 214 includes a shaft 268, extending through a circular aperture 270 in the horizontal surface 226 of the header 22. The circular aperture 270 is sized and shaped to substantially prevent lateral and front-to-back motion of the adjustment feature 214 relative to the refrigerated case frame 16. The shaft 268 further extends through the third aperture 260 such that a first end of the shaft 268 is disposed above the horizontal surface 226 and a second 274 is disposed below the horizontal surface 226 of the header 22.

The adjustment feature 214 is configured to act as a pinion and the plate 222 as a rack. The teeth 266 of the adjustment feature 214 are disposed at or near the first end 272 of the shaft 268 and are configured to mesh with the teeth 264 of the third aperture 260 of the plate 222. By rotating the adjustment feature 214, the adjustment feature 214 can be used to drive the plate 222. As the adjustment feature 214 is rotated, the teeth 266 of the adjustment feature 214 apply a force the teeth 264 of the third aperture 260. This force causes the plate 222 to move laterally relative to the adjustment feature 214 and the refrigerated case frame 16. Lateral movement of the plate 222 relative to the refrigerated case frame 16 causes the spring-loaded pin assembly 100 and the hold-open linkage 224 to also be moved laterally relative to the refrigerated case frame 16. Because the position of the modular door system 14 is related to the position of the spring-loaded pin assembly 100 and the hold-open linkage 224, by moving the plate 222 laterally relative to the refrigerated case frame 16, one can square the modular door system 14 with the refrigerated case frame 16.

The adjustment feature 214 is rotated by first loosening a nut 276 disposed about the shaft 268 at or near the second end 274 (e.g. with the tool 200 according to an exemplary embodiment). After loosening nut 276, the shaft 268 (and the pinion connected thereto) can be rotated using a suitable tool (e.g. Phillips screwdriver, etc.). As shown in FIGS. 11-12, the direction the plate 222 moves depends on whether the adjustment feature 214 is rotated in a clockwise or counterclockwise direction. It should be noted that the thin profile of the tool 200 facilitates accessing and loosening the nut 276 and the pin 114 of the spring-loaded pin assembly 100, which are both shown disposed in a relatively narrow space between the horizontal surface 226 of the header 22 and the first horizontal rail element 42 of the door rail 40 of the modular door system 14 (when the door is in or near the closed position).

In the exemplary embodiment shown, the aperture 204 is at a first end 280 of the tool 200 and the first slot 206 and the second slot 212 are at a second end 282 of the tool 200. The generally elongated shape of the tool 200 is intended to provide a lever arm that may facilitate use of one or more of the engagement features during installation. According to other exemplary embodiments, the tool may have other suitable shapes and/or the engagement features may be otherwise positioned (e.g., the tool may be substantially triangular, having an engagement feature at each corner). It should be noted, that more than three engagement features may be incorporated into a single tool.

According to an alternative embodiment, one or more of the functions of the tool 200 may be provided by a different, separate tool.

Figure 13:
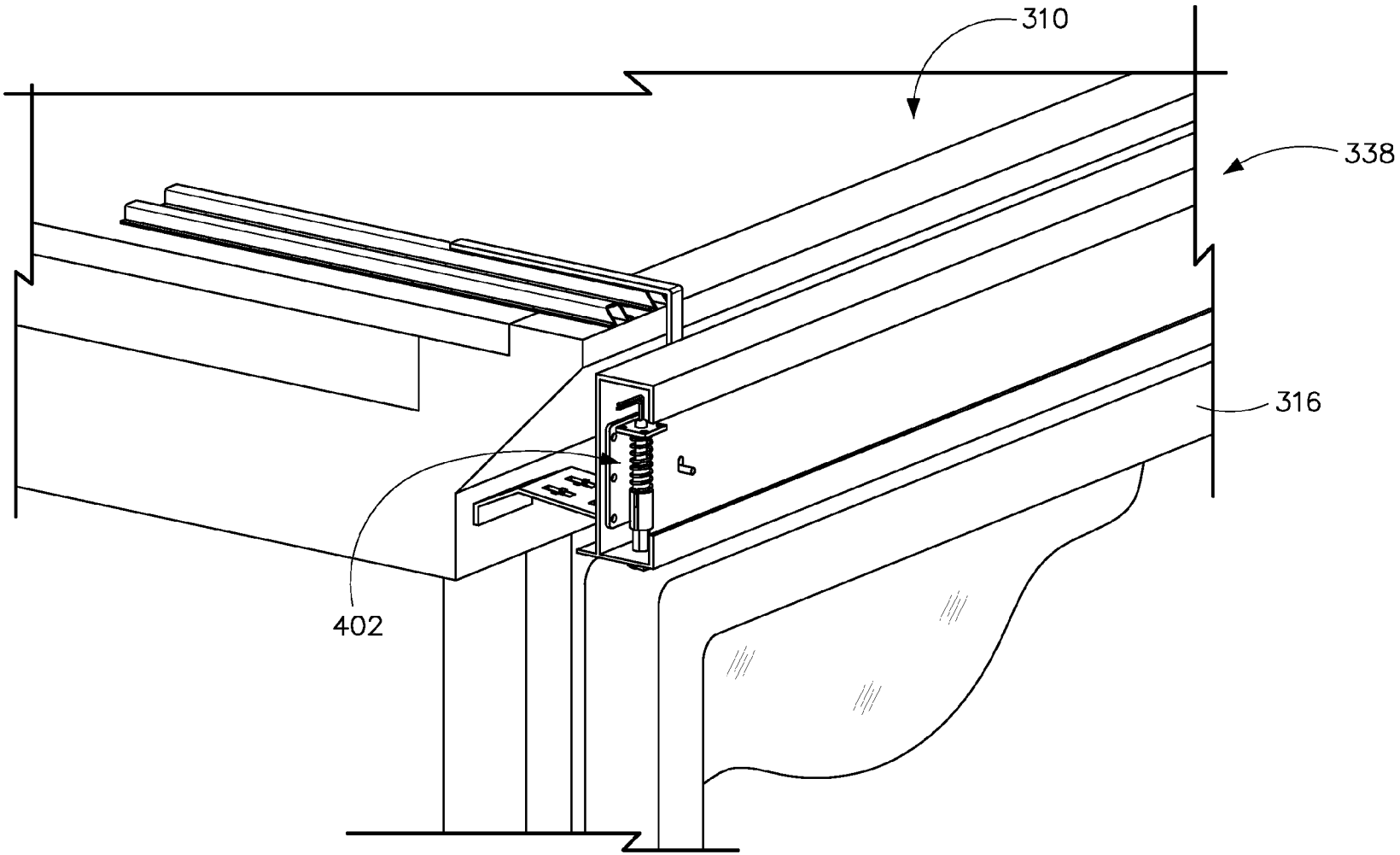
FIG. 13 is a partial, front perspective view of a temperature-controlled case according to a second exemplary embodiment.
Figure 14A:
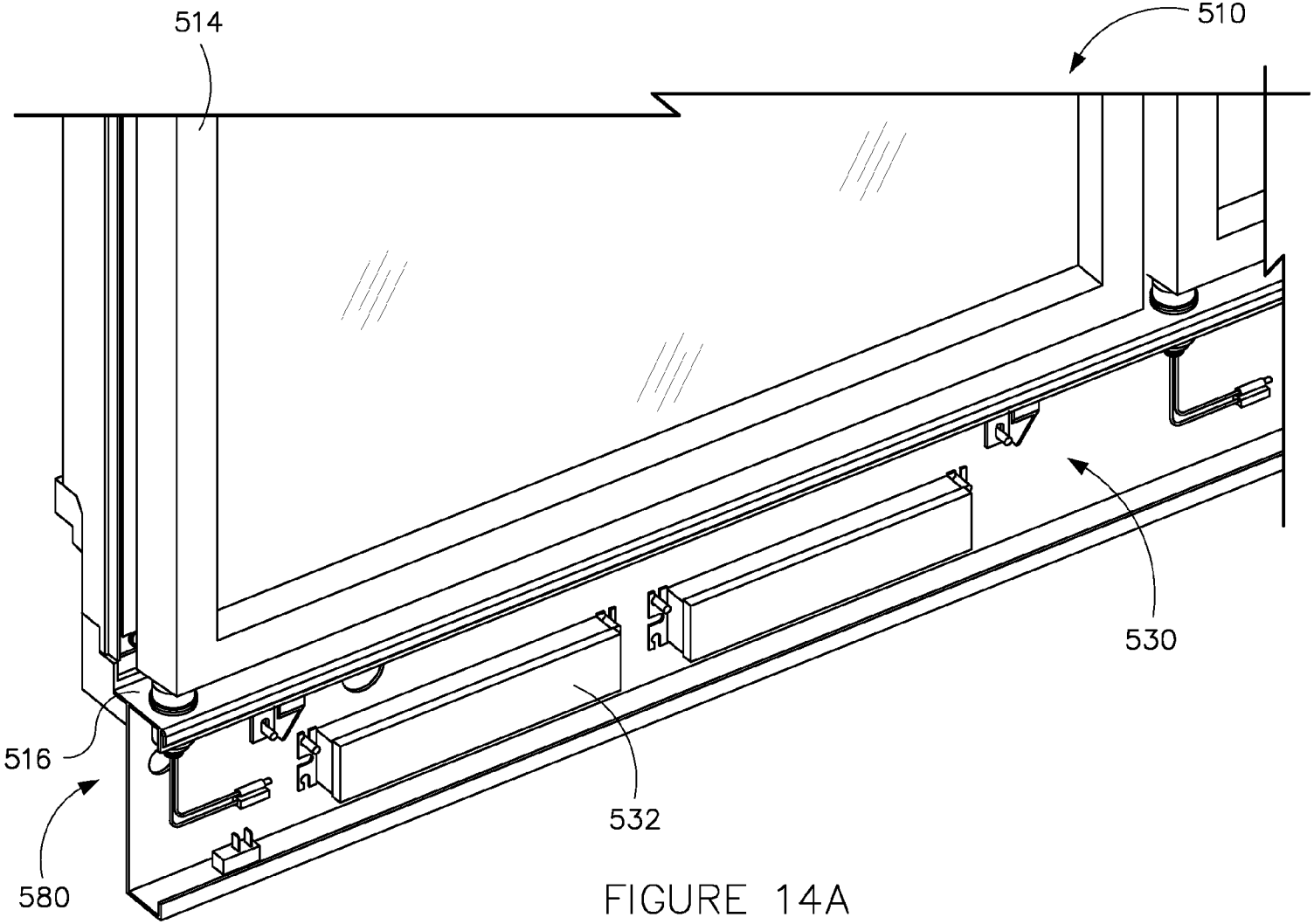
FIGS. 14A-14D are views of a lower portion of a door and temperature-controlled case according to another exemplary embodiment.
Figure 14B:
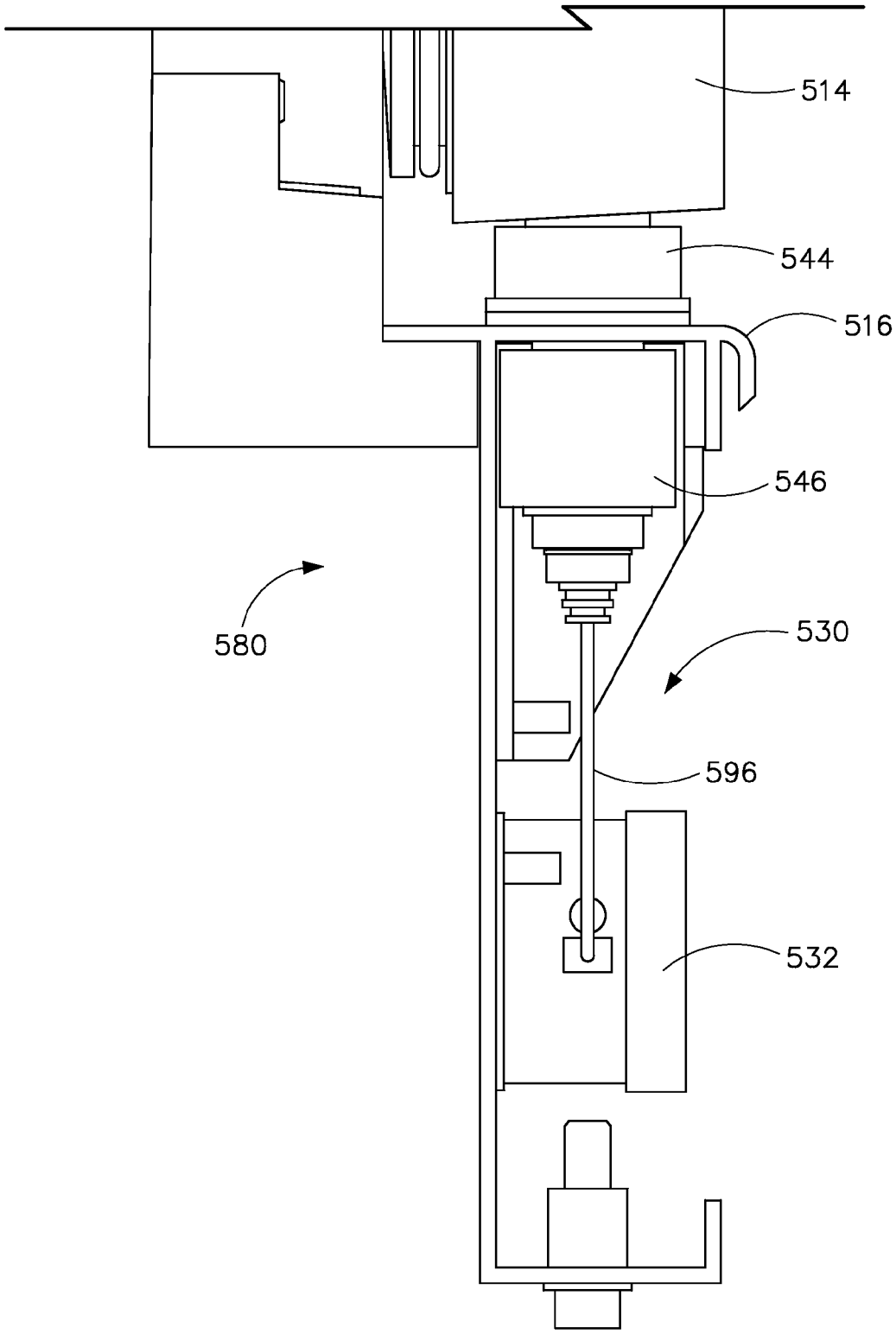
Figure 14C:
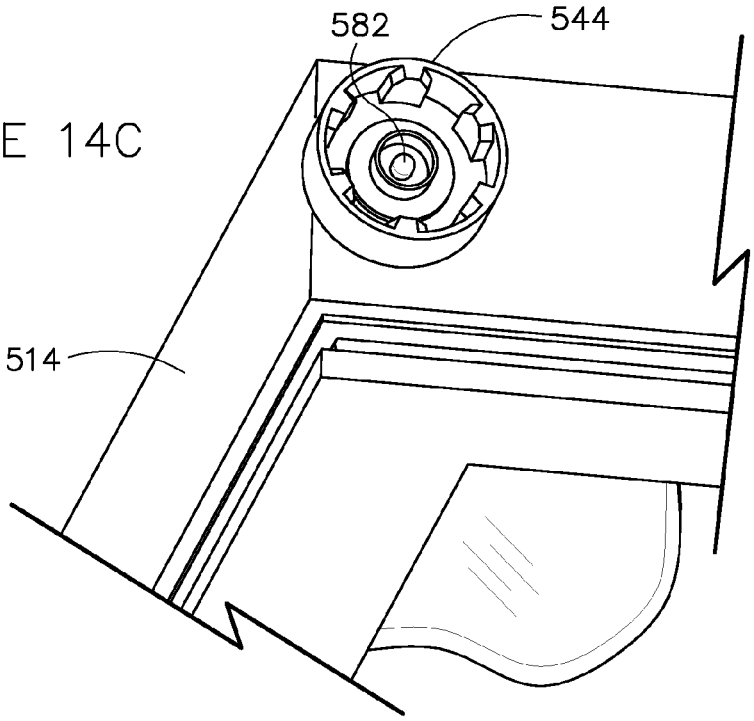
Figure 14D:
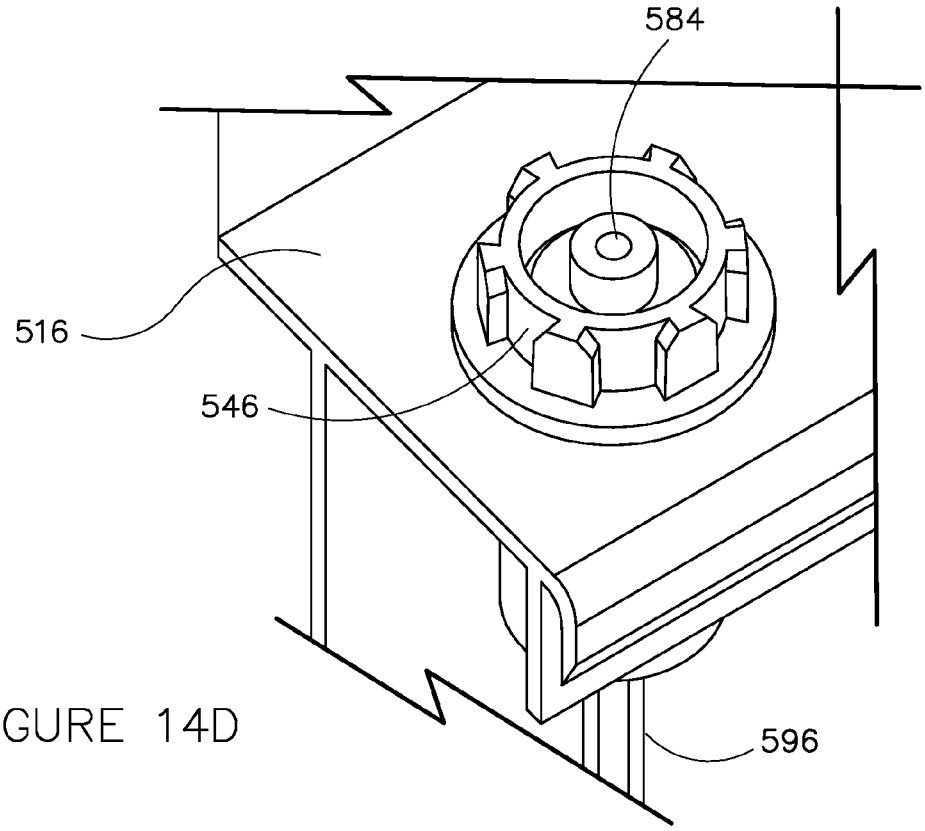
Figure 15A:
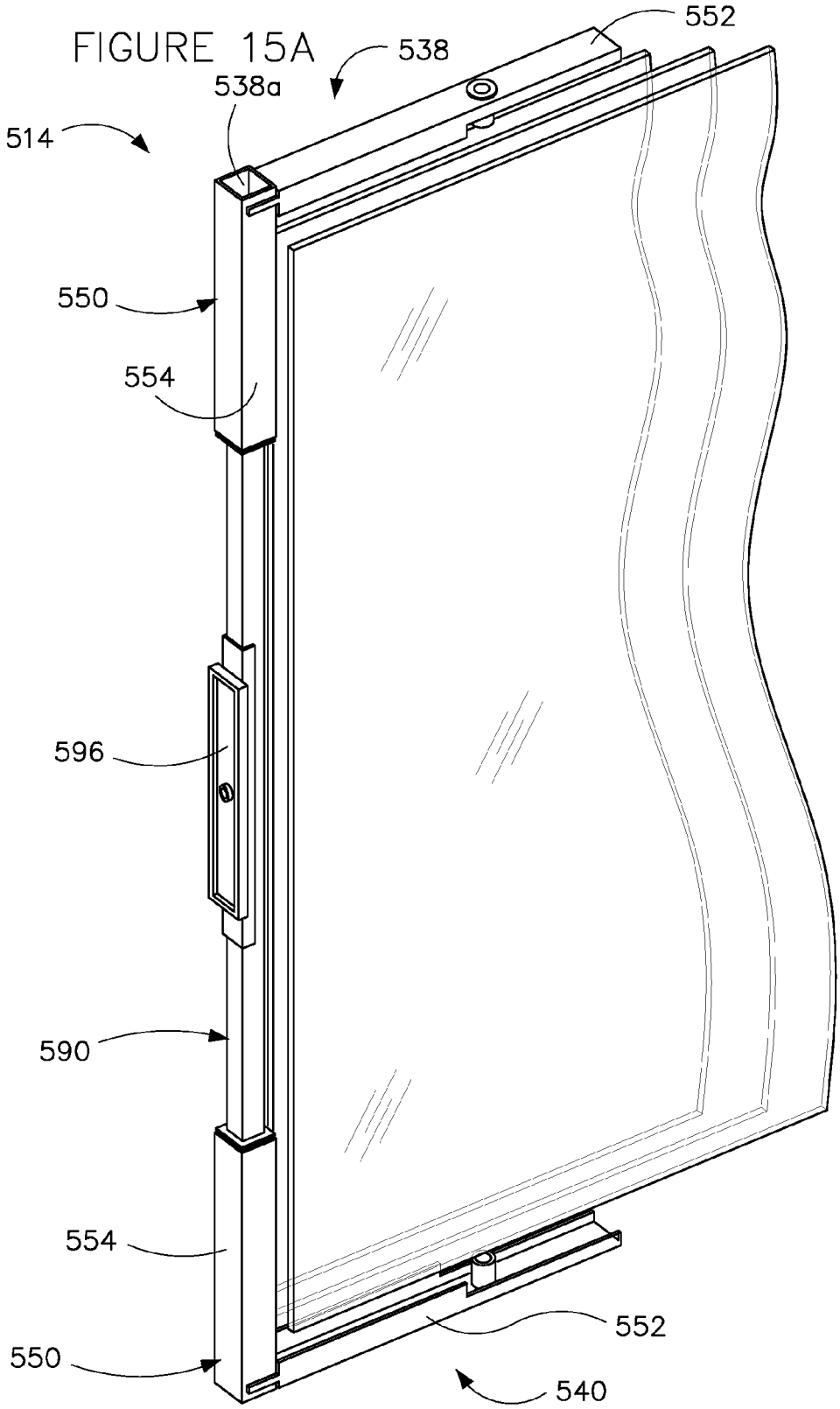
FIGS. 15A-15D are views of frame portions of the door according to the exemplary embodiment shown in FIGS. 14A-14D.
Figure 15B:
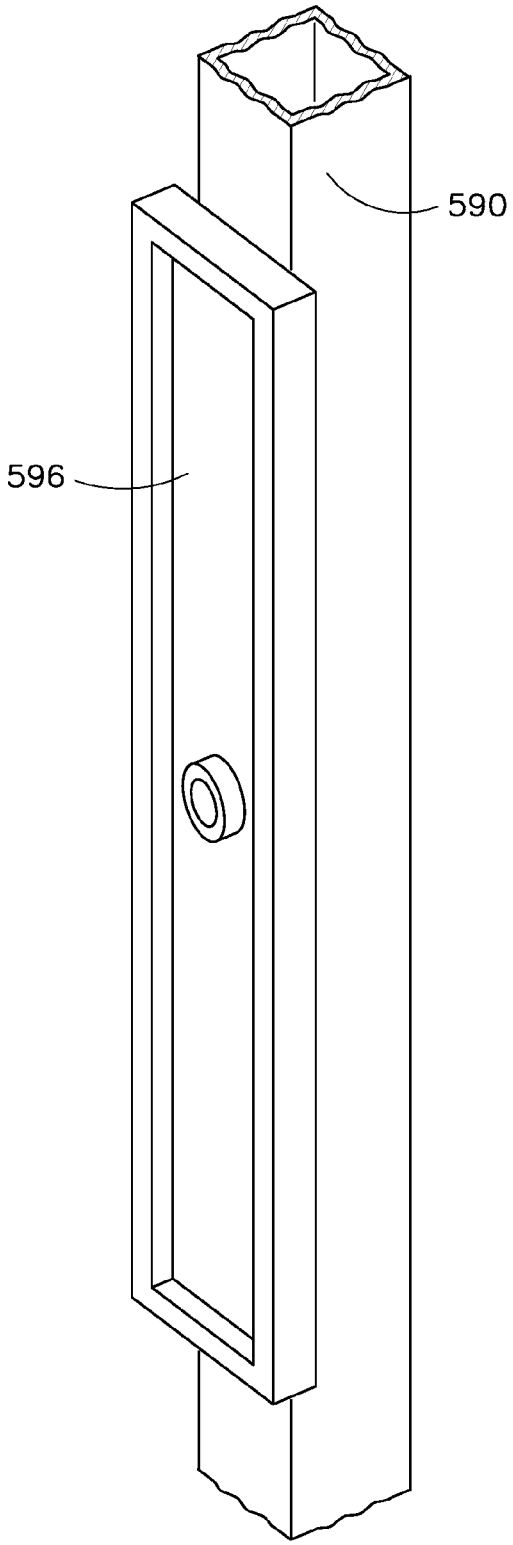
Figure 15C:
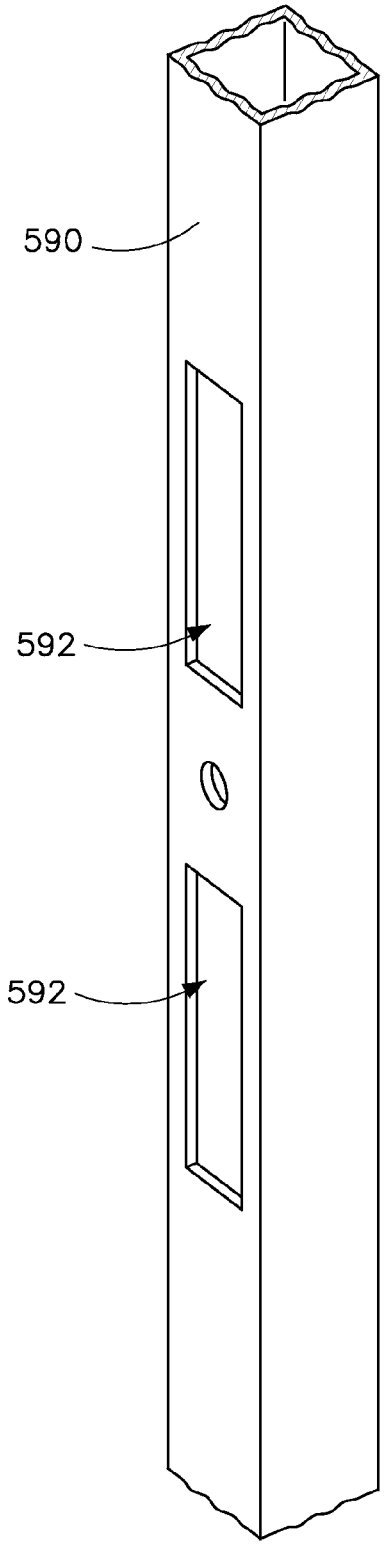
Figure 15D:
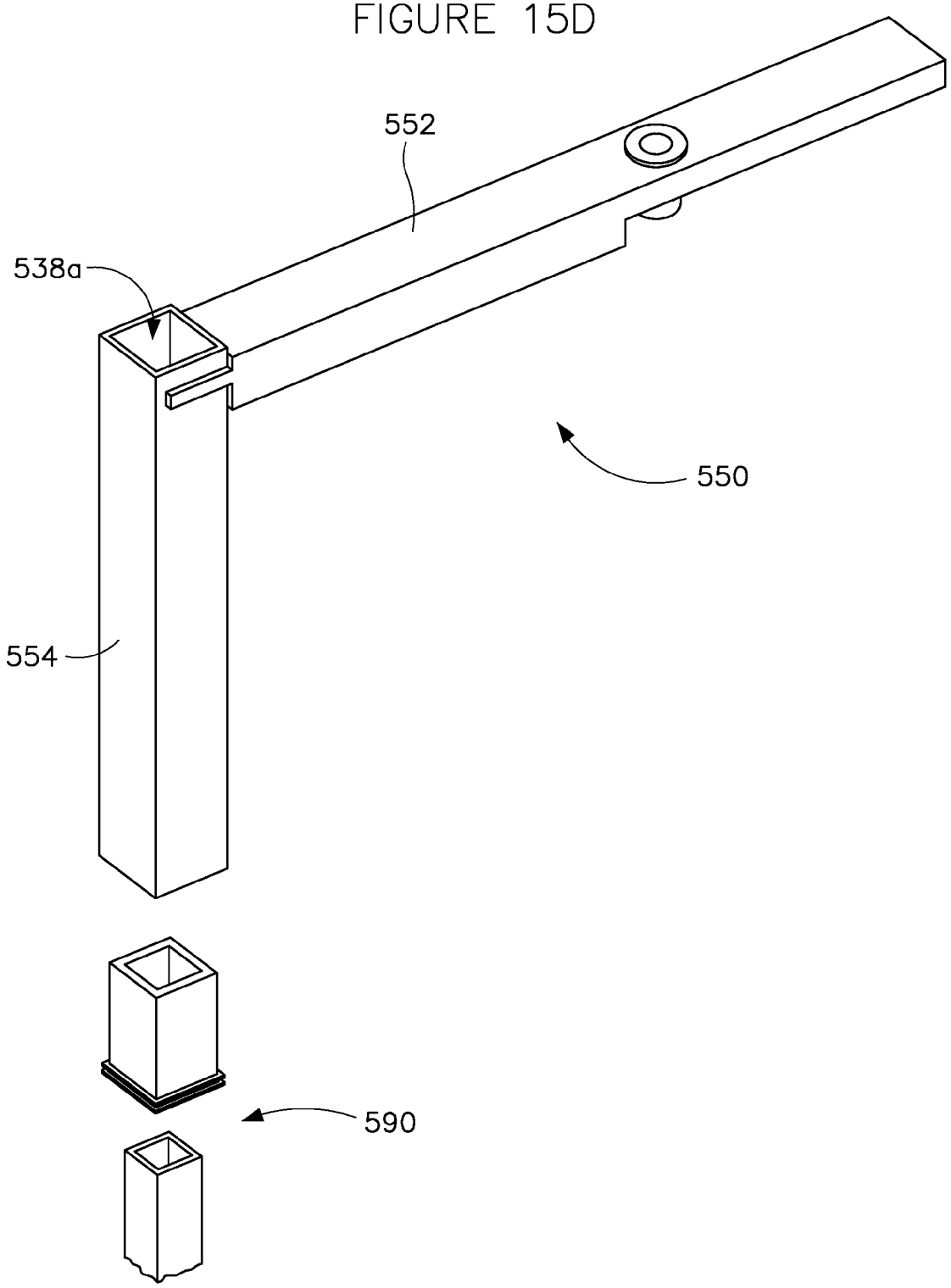

Referring to FIG. 13, a second exemplary embodiment of a refrigerated case 310 is shown according to an exemplary embodiment. Similar to the refrigerated case 10, the refrigerated case 310 includes a door closing control 402. However, unlike the refrigerated case 10, the door closing control 402 in the refrigerated case 310 is disposed above a door 316 at an upper side 338 of the refrigerated case 310, rather than below the door. According to other exemplary embodiments, the door control device or elements thereof may be incorporated into a refrigerated case in any number of suitable manners and/or locations. According to other exemplary embodiments, one or more components/features other than or in addition to the door control device may also be incorporated into a refrigerated case in any number of suitable manners and/or locations.

Referring to FIGS. 14A-17C, a third exemplary embodiment of the refrigerated case 510 is shown according to an exemplary embodiment. Similar to the refrigerated case 10, the refrigerated case 510 includes a door closing control assembly shown as a torque control device or assembly 502. However, unlike the refrigerated case 10, the door closing control 502 in the refrigerated case 510 is disposed above a door 516 at an upper side 538 of the refrigerated case 510, rather than below the door. Although a number of additional features are disclosed in the embodiment of FIGS. 14A-17C, any one or more of the elements, components or features of the previously disclosed embodiments may be included herein. All such variations are intended to be within the scope of this embodiment.

Referring more particularly to FIGS. 14A-14D, an electrical connectivity system 580 is shown that is similar to the embodiment of FIGS. 6-8 and is located proximate a bottom portion of the door 514, however, the torque control portion has been removed and is relocated to an upper portion 538 of the door 516. Electrical connectivity system 580 includes at least a first electrical connector 582 removably coupleable to a second electrical connector 584 according to an exemplary embodiment. The electrical connectivity system 580 is configured to provide an electrical connection between the modular door system 514 of the temperature-controlled case and one or more electrical devices external thereto. The first electrical connector 582 of the electrical connectivity system 580 is configured to be mechanically and electrically coupled to the modular door system 514. The second electrical connector 584 of the electrical connectivity system 580 is configured to be mechanically coupled to the refrigerated case frame 516 and electrically coupled to the electrical components of the refrigerated case 510 external to the modular door system 514. Accordingly, by coupling the first electrical connector 582 and the second electrical connector 584 (e.g. by spring-biased contact, etc.), the modular door system 514 may be electrically coupled to electrical components 532 of the refrigerated case 510 external to the modular door system 514 (e.g., housed in or coupled to the refrigerated case frame 516, such as in compartment 530). The ability to electrically couple the door 514 to external associated electrical components 532 is intended to provide a number of advantages. For example, the electrical connectivity system 580 permits power from electrical components 532 to be delivered to anti-condensation or anti-fog heating elements that may be provided on (or otherwise integrated with) the door 514. According to another example, the electrical connectivity system 580 permits power from electrical components 532 (such as LED electronics, drivers or other components) to be delivered to LED lighting devices that may be provided on (or otherwise integrated with) the door 514. First electrical connector 582 is shown concentrically disposed within first coupling device 544 (which may be similar to first element 144 as shown in FIG. 4), and second electrical connector 584 is shown concentrically disposed within second coupling device 546 (which may be similar to first element 146 as shown in FIG. 4), so that when the modular door system 514 is mounted on to the refrigerated case frame 516, the first and second electrical connectors, 582, 584 are brought into mechanical and electrical engagement with each other (e.g. axially aligned and in contact with each other). Engagement of the first and second electrical connectors 582, 584 with each other permits relocation of all or a majority of the electrical components 532 associated with the door 514 (e.g. ballasts, power supplies, drivers, relays, switches, etc.) from the frame 516 and to the compartment 530.

Referring further to FIGS. 14A-14D, coupling the first coupling device 544 to the second coupling device 546 is configured to also couple the first electrical connector 582 and the second electrical connector 584 according to an exemplary embodiment. The first coupling device 544 and the second coupling device 546 each include a centrally-located cavity aligned along a pivot axis of the door. These centrally-located cavities are configured to at least partially receive and retain the first electrical connector 582 and the second electrical connector 584. When disposed within the centrally-located cavities, the first electrical connector 582 is annularly aligned with the first coupling device 544, and second electrical connector 584 is annularly aligned with the second coupling device 546. In the exemplary embodiment shown, the electrical conductor 596 is electrically coupled between the second electrical connector 584 to the electrical devices 532 in the compartment 530. So that when the modular door system 514 is coupled (e.g. mounted, installed, etc.) to the refrigerated case frame 516, the first and second coupling devices 544 and 546 quickly and accurately engage each other (e.g. though tapered and interfacing splines) and the modular door system 514 is electrically coupled to the electrical devices 532 in the compartment 530 in a "plug-and-play" manner. As discussed above, with this configuration, the modular door system 514 can maintain its electrical functionalities without the electrical devices being relocated from the frame 516 to the compartment 530.

Figure 16A:
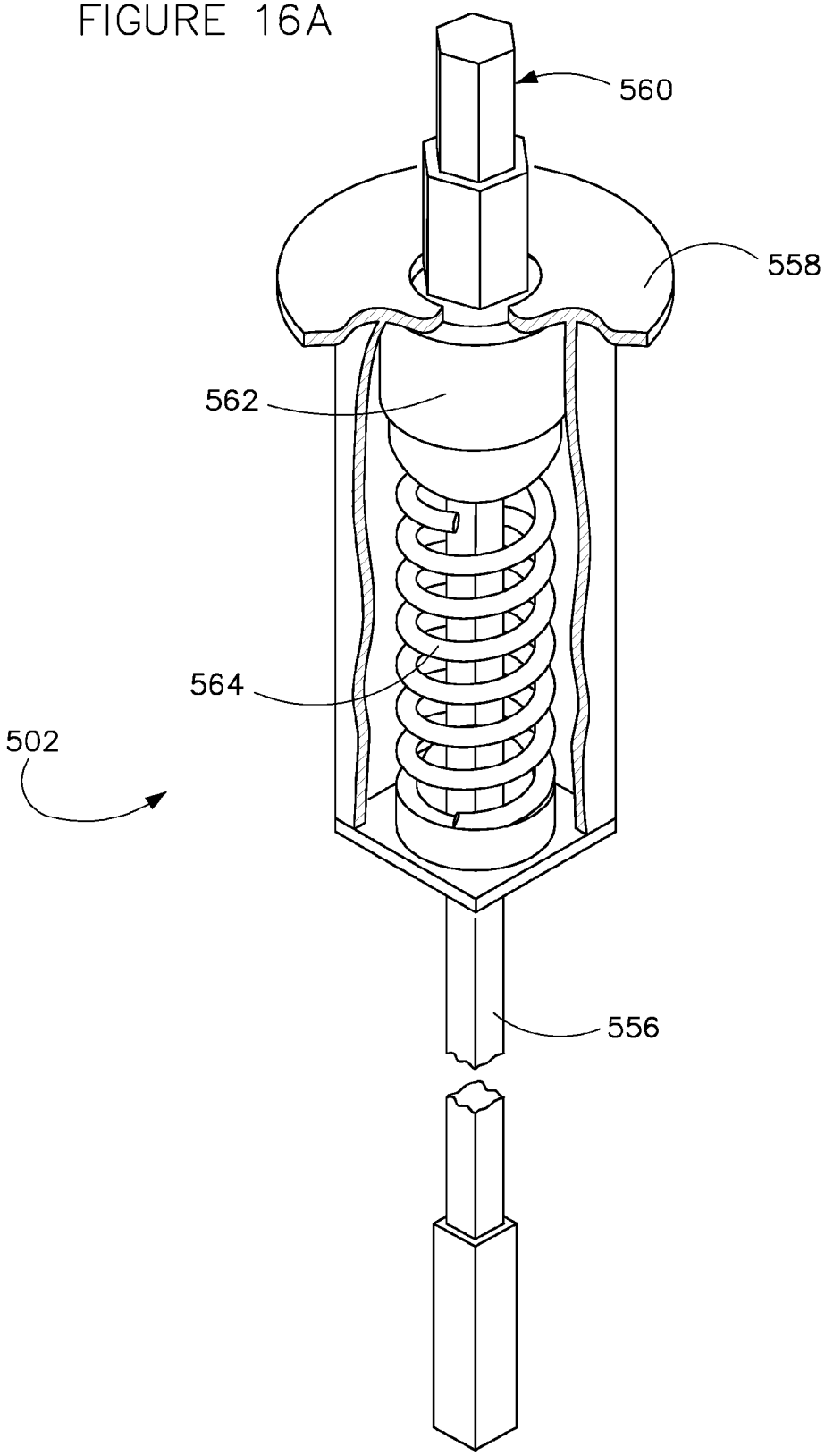
FIGS. 16A-16B are views of a torque control device for use with the frame portion of the door according to the exemplary embodiment shown in FIGS. 14A-14D.
Figure 16B:
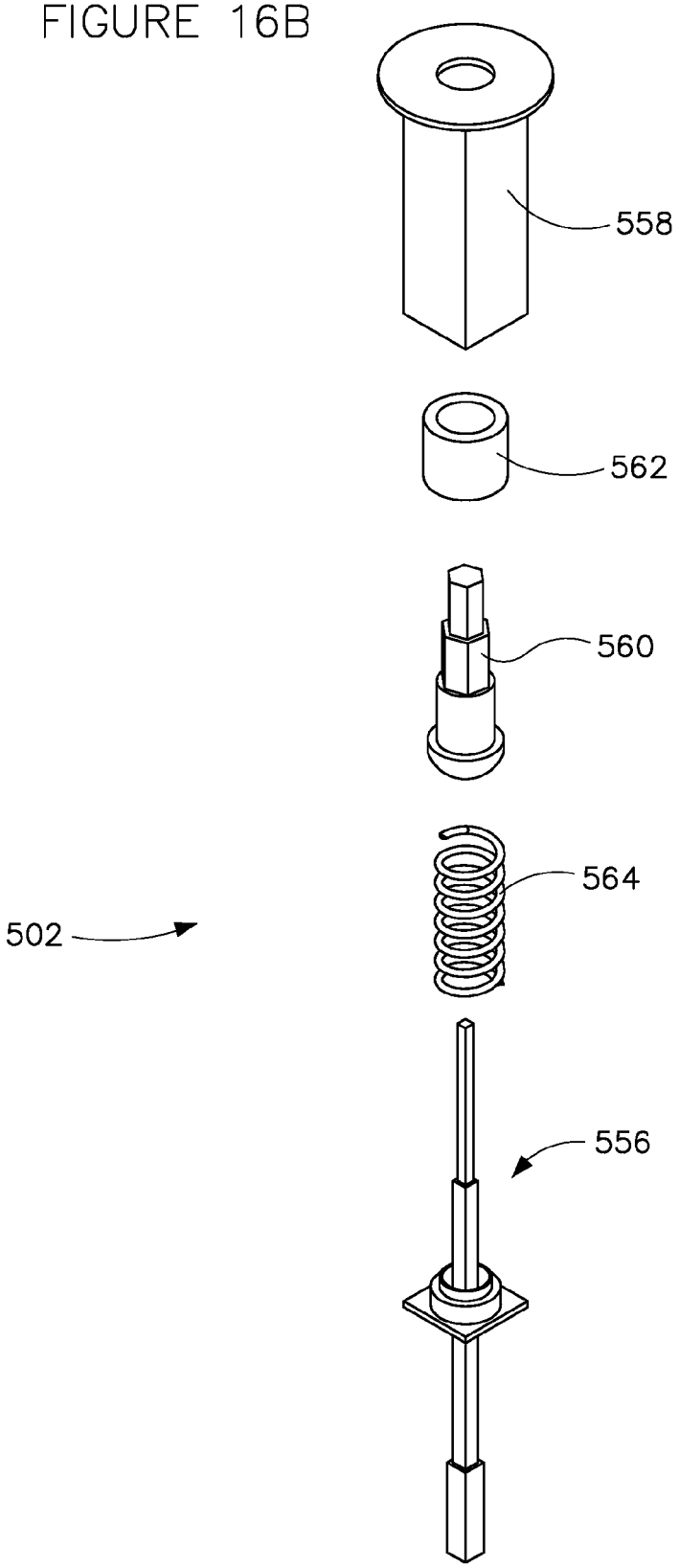
Figure 17A:
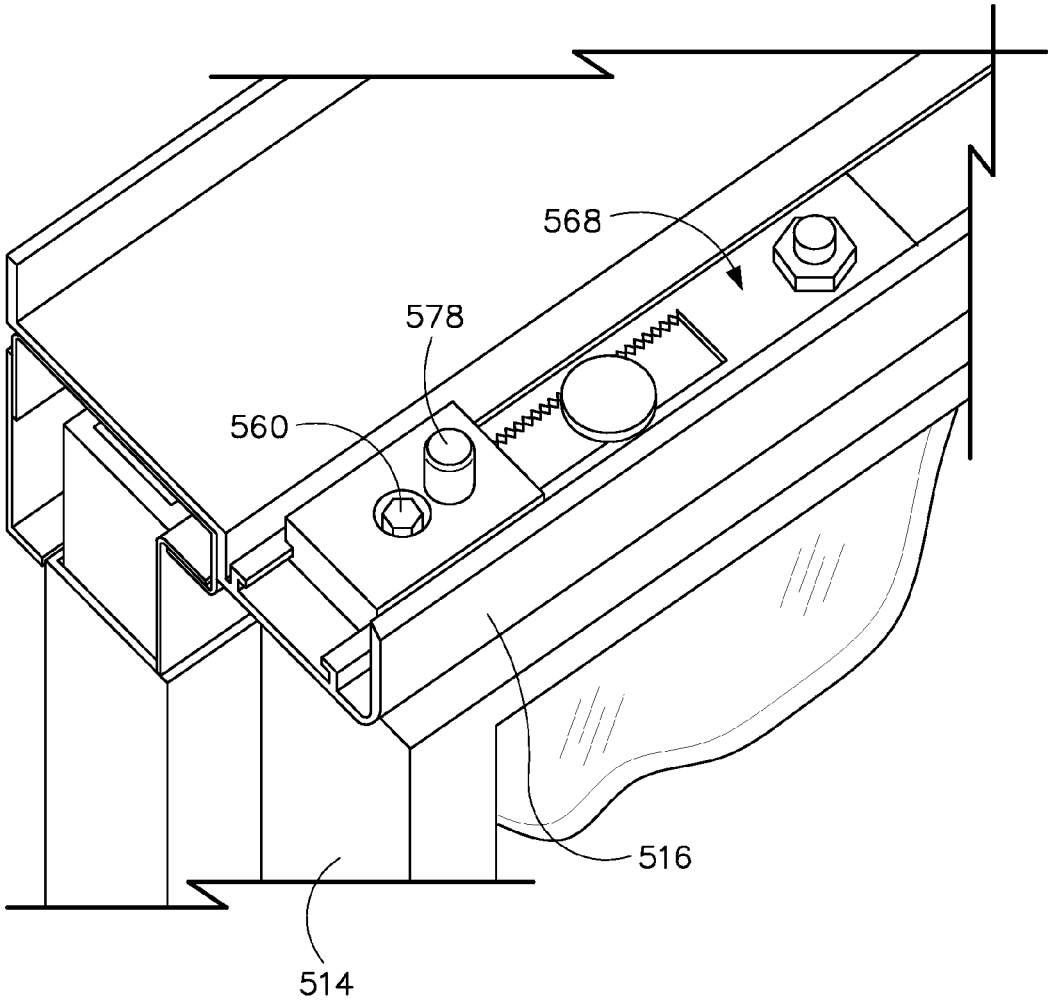
FIGS. 17A-17C are views of a pre-loading device for pre-loading the torque control device in the frame portion of the door according to the exemplary embodiment shown in FIGS. 14A-14D.
Figure 17B:
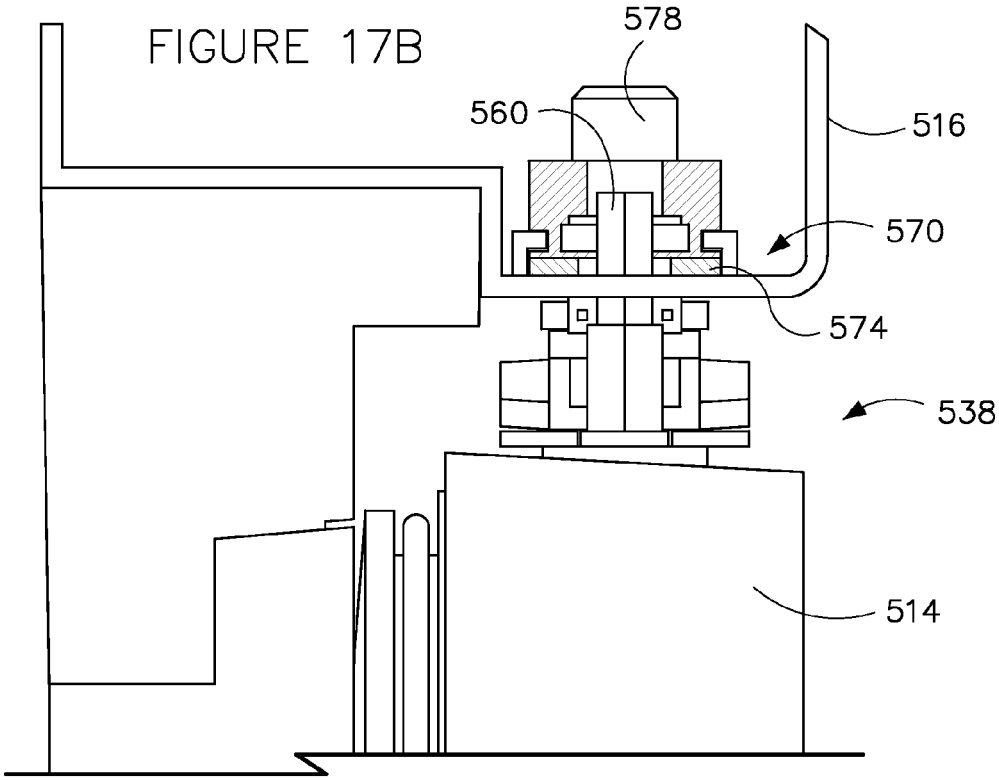
Figure 17C:
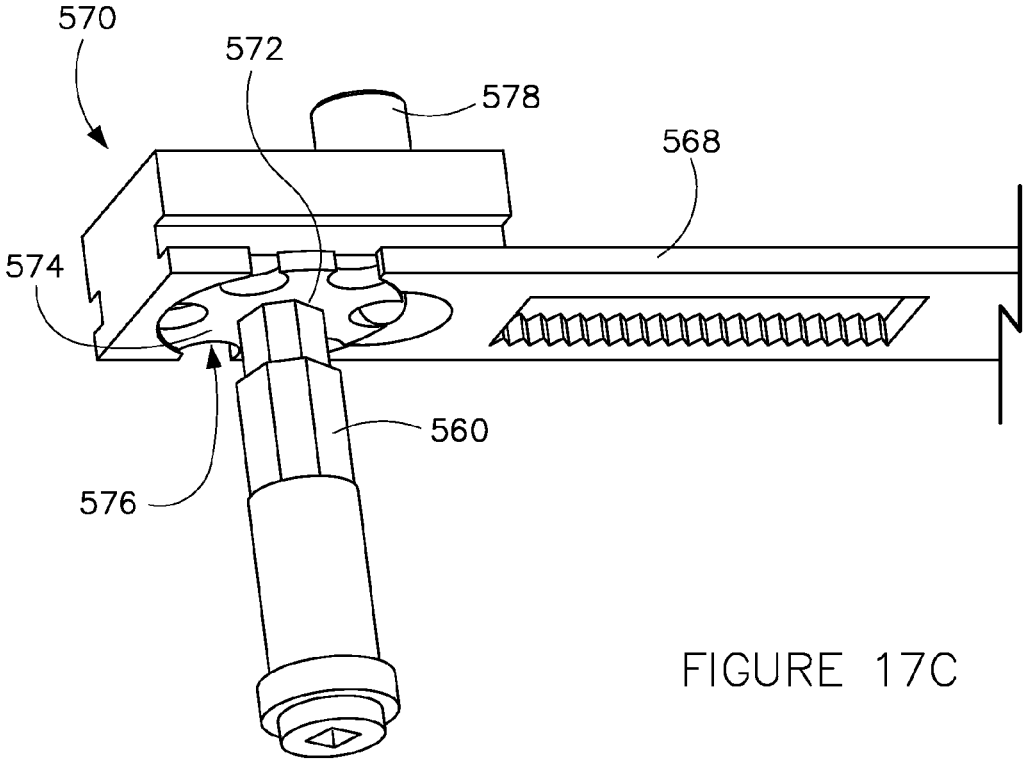

Referring further to FIGS. 15A-15D, the modular door system 514 is shown to include embedded components, including raceway passage 190 (e.g. shown as a tube having a substantially square cross section) and shown to extend continuously from a top portion 538 of the door 514 to a bottom portion 540 of the door. Raceway passage 590 may include a junction box area having suitable openings 592 (e.g. knockouts, etc.) for connection of electrical conductors or components routed through the raceway passage 590 (such as electrical conductors coupled to first electrical connector 582, etc.), and may include an access panel or cover 596. Door system 514 is also shown to include a reinforcing bracket 550 disposed proximate a top portion 538 and a bottom portion 540 of the door 514 and having a horizontal portion 552 (configured to engage a hold-open device and door-squaring mechanisms, etc., such as shown in FIGS. 17A-17C) and a vertical hollow portion 554 that fits over (or is formed as part of, or otherwise engages) raceway passage 590 (and is configured to receive a torque control device 502, such as shown in FIGS. 16A-16B). Raceway passage 590 and vertical hollow portions 554 and their receptacles of bracket 550 are configured as a universal receptacle that is capable of interchangeably receiving the torque control device 502 in either the top 538 or bottom 540 of the door 514, and interchangeably receiving the first electrical coupling device 544 in either the top 538 or the bottom 540 of the door 514. According to the illustrated embodiment, the modular door system 514 can quickly and easily be assembled (e.g. in a factory) or reassembled (e.g. in the field) as either a right-hand door or a left hand door, simply by installing the torque control device 502 on the "top" of the door 514 and the first electrical connector 544 on the "bottom" of the door 514, or vice-versa (recognizing that the top and the bottom of the door change positions as the door is turned upside-down or end-for-end to change from a right hand orientation to a left-hand orientation).

Referring further to FIGS. 16A-16B, a door closing control (shown as the torque control device 502) that serves as a door closing mechanism is shown according to an exemplary embodiment. Torque control device 502 includes an elongated bar 556 having a bottom end that is rotationally fixed within the vertical hollow portion 554 of the reinforcing bracket 550 or within the raceway passage 590 in the door frame, and a top end that is rotationally fixed to the top (e.g. header, etc.) of the refrigerated case frame 516, so that the elongated bar 556 'twists' when the door 514 is moved about its pivot axis (i.e. opened) and acts as a torsion spring intended to rotationally bias the modular door system 514 toward a closed position. Bar 556 is shown having a substantially square cross-section having dimensions of approximately ⅛ inch by ⅛ inch, but other suitable shapes and sizes may be used. According to one embodiment, bar 556 is approximately 30 inches long and is axially aligned with a pivot axis of the door 514, with the square bottom end of bar 556 releasably seated or captured (e.g. by a sliding-fit, press-fit, etc.) within a corresponding square recess, crimp or pocket within vertical portion 554 of the reinforcing bracket 550 or the raceway passage. The top portion of bar 556 is shown to include a spring-biased plunger assembly that includes a collar 558 having a square external portion configured to releasably and interchangeably fit within the square aperture or receptacle (shown as receptacle 538*a* in bracket 550 in FIG. 15D). Collar 558 also includes a bore configured to slidably receive a plunger 560 that is rotationally supported by a bushing 562, and a spring 564 configured to axially bias the plunger 560 upwardly into engagement with an aperture 572 (see FIG. 17C) in the header of the refrigerated case frame 516. The plunger 560 can have a square aperture configured to fit over the square top end of bar 556, but may be coupled or formed with the top of the bar 556 in any suitable manner. Plunger 560 and aperture 572 are sized and shaped to mate with one another in a non-rotational manner (e.g. shown for example as hexagonal shaped) so that the top end of the bar 556 is fixed to the top of the case frame 516, and the bottom end of the bar 556 is fixed to the door 514. According to one embodiment, the torque control device 502 is a separate subassembly that can be quickly and conveniently installed in (or removed from) the raceway passage 590 in the modular door 514, such as by sliding the torque control device 502 through aperture 538*a* and into and out of the raceway passage 590.

Referring to FIGS. 17A-17C, the top (e.g. header, etc.) of the refrigerated case frame 516 includes a door-squaring mechanism 568, which may be similar to that previously described with reference to FIG. 12), and a preload device 570 having aperture 572 that is configured to receive the top of the plunger 560. Preload device 570 is shown by way of example as a rotatable disc or wheel 574 seated within the door squaring mechanism 568. Disc 574 includes aperture 572 disposed in a central location that is axially aligned with the pivot axis of the door 514. Disc 574 also includes a plurality of peripheral apertures 576 (shown by way of example as six apertures). A locking preload pin 578 is slidably received above disc 574. The preload device 570 is intended to cooperate with the door 514 so that the torque control device 502 applies an initial biasing force on the door 514 when the door 514 is in the closed position. The door 514 may be preloaded by rotating the top of the bar 556 when it is received in aperture 572 of the disc 574 (e.g. by manual force using a wrench applied to the hexagonal shaped plunger 560) and then inserting the locking preload pin 578 into a corresponding peripheral aperture 576 when a desired preload force has been reached.

According to any preferred embodiment of the features shown in FIGS. 14A-17C, a temperature-controlled case is provided including a frame at least partially defining a temperature-controlled space and a modular door 514 pivotable about a pivot axis between a preloaded closed position and an open position. The door 514 includes a raceway passage 590 that serves as a universal receptacle for receiving a torque control device 502 in either the top 538 or bottom 540 of the door 514, and for receiving a first electrical coupling device 544 in either the top 538 or the bottom 540 of the door 514, so that the modular door system 514 can quickly and easily be assembled or reassembled as either a right-hand door or a left hand door, simply by installing the torque control device 502 on the "top" of the door 514 and the first electrical connector 582 and first coupling device 544 on the "bottom" of the door, or vice-versa. The torque control device 502 includes an elongated bar 556 that is rotationally fixed at its bottom end to the door and at its top end to the refrigerated case frame 516, so that as the door 514 is opened, the bar "twists" about its axis and provides an increasing torsional biasing force to urge the door 514 back toward its closed position. The first electrical connector 582 is configured to couple with electrical conductors within the raceway passage 590, and to quickly and conveniently engage a second electrical connector 584 that is mounted on a bottom of the refrigerated case frame 516, so that an electrical connection is made between the door 514 and any of a variety of electrical devices 532 that are relocated from the door 514 to a compartment 530 in the refrigerated case 510.

According to any exemplary embodiment, a temperature-controlled case is provided including a frame at least partially defining a temperature-controlled space and a door pivotable about a pivot axis between a closed position and an open position. The temperature-controlled case includes a door closing control configured to bias the door toward the closed position. The door closing control may include a hinge for transforming rotary motion into linear motion. The door closing control may also include a torque transfer coupling including a first element removably coupleable to a second element to help couple and uncouple the door to the frame. When the door is coupled to the frame, a spring of the hinge may provide a translational force that operably imparts a rotational force on the door in the direction to move the door from the open position toward the closed position.

According to any exemplary embodiment, a temperature-controlled case is provided including a frame at least partially defining a temperature-controlled space and a door pivotable about a pivot axis between a closed position and an open position. The temperature-controlled case includes a door closing control including a coupling device having a first element coupleable to the door and a second element coupleable to the frame. Coupling the first element and the second element mechanically couples one end of the door to the frame. Coupling the first element and the second element also forms an electrical connection between the door and electrical devices disposed external thereto.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the temperature-controlled case and components thereof as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A temperature-controlled case, comprising:

a frame at least partially defining a temperature-controlled space;

a door pivotable about a pivot axis between a closed position and an open position, the door including a passage at least partially along the pivot axis;

a door closure device having an elongated bar configured to bias the door toward the closed position, and the door closure device coupled to one of a top or a bottom of the door and to the frame;

an electrical connectivity system including a first electrical connector axially aligned with the pivot axis and coupled to the other of the top or the bottom of the door and configured to engage a second electrical connector axially aligned with the pivot axis and coupled to the frame, wherein the first electrical connector extends along the pivot axis outside an external perimeter of the door and engages the second electrical connector outside the external perimeter of the door;

the electrical connectivity system including a first annular coupling device attached to an outer perimeter surface of the door and having a central cavity within which the first electrical connector is at least partially disposed, and a second annular coupling device attached to an inner perimeter surface of the frame and having a central cavity within which the second electrical connector is at least partially disposed, the first and second annular coupling devices being removably engagable with one another via engagement features extending radially from circumferential surfaces thereof.

2. The temperature-controlled case of claim 1, further comprising at least one compartment within the frame, and one or more electrical devices disposed in the compartment, an electrical connection between the electrical devices in the compartment and the door being formed when the first electrical connector is coupled to the second electrical connector.

3. The temperature-controlled case of claim 1, wherein the elongated bar is torsionally pre-loaded to bias the door to the closed position when the door is in the open position and when the door is in the closed position.

4. The temperature-controlled case of claim 3, further comprising a preload device having a disc that is rotatable to, and lockable in, one of a plurality of preload positions.

5. The temperature-controlled case of claim 1, wherein the first and second electrical connectors and the elongated bar are aligned along or parallel to the pivot axis when the door is coupled to the frame.

6. The temperature-controlled case of claim 1, wherein the door closure device and the electrical connectivity system are interchangeably adaptable for engagement with the top of the door and the bottom of the door.

7. The temperature-controlled case of claim 6, wherein the door is a modular door and can be configured for use as a right-hand door or a left-hand door by reversing the orientation of the door closure device and the electrical connectivity system from the top of the door to the bottom of the door.

8. The temperature-controlled case of claim 1, wherein the door closure device further comprises a spring-biased plunger coupled to the elongated bar.

9. A temperature-controlled case, comprising:

a frame;

a door coupleable to the frame and pivotable about a pivot axis between a closed position and an open position;

at least one compartment separate from and adjacent to the door, the compartment housing one or more electrical devices;

an electrical connectivity system including a first annular coupling device attached to an outer perimeter surface of the door and removably engagable with a second annular coupling device attached to an inner perimeter surface of the frame, the first and second annular coupling devices being removably engagable with one another via engagement features extending radially from circumferential surfaces thereof; and a first electrical connector disposed within the first annular coupling device and a second electrical connector disposed within the second annular coupling device;

wherein coupling the first annular coupling device to the second annular coupling device also engages the first electrical connector and the second electrical connector to one another, wherein the first electrical connector extends along the pivot axis outside an external perimeter of the door and engages the second electrical connector outside the external perimeter of the door; and wherein engaging the first electrical connector and the second electrical connector forms an electrical connection between the door and, one or more electrical devices disposed in the compartment.

10. The temperature-controlled case of claim 9, wherein the electrical devices in the compartment are accessible by moving or removing a panel from the compartment.

11. The temperature-controlled case of claim 9, wherein the compartment is disposed substantially along one of an upper side of the temperature-controlled case located generally above the door or a lower side of the temperature-controlled case located generally below the door.

12. The temperature-controlled case of claim 9, wherein the door is configured to remain closed and assembled during maintenance of the electrical devices.

13. The temperature-controlled case of claim 9, wherein the first electrical connector and the second electrical connector are at least partially concentrically disposed within the first coupling device and the second coupling device, respectively.

14. The temperature-controlled case of claim 13, wherein the first electrical connector and the second electrical connector are overmolded into sleeves that are preassembled into the cavities of the first coupling device and the second coupling device.

15. A temperature-controlled case, comprising:

a frame;

a door pivotable about a pivot axis between a closed position and an open position; and a door closing control assembly configured to bias the door toward the closed position, comprising:

an elongated bar having a first end removably received within a passage in the door and rotationally fixed to the door, a rotatable disc having a central aperture configured to removably receive a second end of the elongated bar opposite the first end, wherein the second end is rotationally fixed to the rotatable disc when received in the central aperture, the rotatable disc having a plurality of peripheral apertures parallel to the central aperture, each of the plurality of peripheral apertures corresponding to a different preload position, wherein the rotatable disc is rotatable relative to the frame and lockable relative to the frame at one of the different preload positions by inserting a pin into the corresponding peripheral aperture, wherein the elongated bar increasingly twists and the door rotates relative to the rotatable disc as the door is moved from the closed position toward the open position.

16. The temperature-controlled case of claim 15, wherein the second end of the elongated bar further comprises a plunger that is axially biased toward the aperture in the frame.

17. The temperature-controlled case of claim 15, wherein the door closing control assembly is interchangeably receivable within the passage at a top of the door and a bottom of the door.

18. The temperature-controlled case of claim 15, further comprising an electrical connectivity system including a first coupling device removably coupleable to a second coupling device, a first electrical connector substantially annularly aligned within the first coupling device and a second electrical connector substantially annularly aligned within the second coupling device, wherein coupling the first coupling device to the second coupling device also couples the first electrical connector and the second electrical connector.

19. The temperature-controlled case of claim 18, wherein the electrical connectivity system is interchangeably receivable with the passage at a top of the door and a bottom of the door.

20. The temperature-controlled case of claim 19, wherein the door is a plug-and-play modular door that is interchangeable from a right-hand orientation to a left-hand orientation by interchangeably moving the door closure control assembly and the electrical connectivity system from between the top of the door and the bottom of the door.

21. A temperature-controlled case, comprising:

a frame:

a door coupled to the frame and pivotable about a pivot axis between a closed position and an open position, the door including a passage that interchangeably receives a door closure control assembly at one of the top or the bottom of the door, and an electrical connectivity system at the other of the top or the bottom of the door;

the electrical connectivity system including a first electrical connector coupled to the door and a second electrical connector coupled to the frame, wherein the first and second electrical connectors are engaged and in axial alignment when the door is coupled to the frame and while the door is moved between the closed position and the open position, wherein the first electrical conductor extends along the pivot axis outside an external perimeter of the door and engages the second electrical conductor outside the external perimeter of the door;

the electrical connectivity system including a first annular coupling device attached to an outer perimeter surface of the door and having a central cavity within which the first electrical connector is at least partially disposed, and a second annular coupling device attached to an inner perimeter surface of the frame and having a central cavity within which the second electrical connector is at least partially disposed, the first and second annular coupling devices being removably engagable with one another via engagement features extending radially from circumferential surfaces thereof;

the door closure control assembly comprising a torsion spring that is fixed at one end to the door and fixed at another end to the frame, so that when the door is opened the torsion spring provides an increasing force to urge the door toward the closed position.

22. A temperature-controlled case, comprising:

a frame:

a door coupled to the frame and pivotable about a pivot axis between a closed position and an open position, the door including a passage that interchangeably receives a door closure control assembly at one of the top or the bottom of the door, and an electrical connectivity system at the other of the top or the bottom of the door;

the electrical connectivity system including a first annular coupling device attached to an outer perimeter surface of the door and removably engagable with a second annular coupling device attached to an inner perimeter surface of the frame, a first electrical connector concentrically disposed within the first annular coupling device and a second electrical connector concentrically disposed within the second annular coupling device, the first and second annular coupling devices being removably engagable with one another via engagement features extending radially from circumferential surfaces thereof, wherein coupling the first coupling device to the second coupling device also axially aligns and connects the first electrical connector to the second electrical connector, wherein the first electrical connector extends along the pivot axis outside an external perimeter of the door and connects to the second electrical connector outside the external perimeter of the door.

* * * * *